US007905584B2

(12) United States Patent
Sakakitani

(10) Patent No.: US 7,905,584 B2
(45) Date of Patent: Mar. 15, 2011

(54) IMAGE FORMING APPARATUS AND IMAGE FORMING METHOD

(75) Inventor: Masatoshi Sakakitani, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 594 days.

(21) Appl. No.: 11/827,613

(22) Filed: Jul. 12, 2007

(65) Prior Publication Data

US 2008/0012893 A1 Jan. 17, 2008

(30) Foreign Application Priority Data

Jul. 12, 2006 (JP) ..... 2006-191641

(51) Int. Cl.
*B41J 29/393* (2006.01)
*B41J 29/38* (2006.01)
*B41J 2/175* (2006.01)

(52) U.S. Cl. ..... 347/85; 347/6; 347/19

(58) Field of Classification Search ..... 347/6, 85, 347/19

See application file for complete search history.

(56) References Cited

U.S. PATENT DOCUMENTS 6,164,742 A * 12/2000 Hauck ..... 347/6
6,318,851 B1 * 11/2001 Hoen et al. ..... 347/92
2005/0194730 A1 9/2005 Nishida et al.
2006/0050104 A1 3/2006 Sakakitani
2006/0181569 A1 8/2006 Kawashima et al.

FOREIGN PATENT DOCUMENTS

JP 2005-262686 9/2005
JP 2005-271389 10/2005

* cited by examiner

*Primary Examiner* — Julian D Huffman
(74) *Attorney, Agent, or Firm* — Cooper & Dunham LLP

(57) ABSTRACT

An image forming apparatus includes at least one liquid discharging head and a pressure release member. The at least one liquid discharging head is configured to discharge a liquid to form an image. The pressure release member is configured to adjust an inner air pressure in the at least one liquid discharging head to be continuously equivalent to an outer air pressure.

17 Claims, 26 Drawing Sheets

IMAGE FORMING APPARATUS AND IMAGE FORMING METHOD

TECHNICAL FIELD

The present specification describes an image forming apparatus and an image forming method, and more particularly an image forming apparatus and an image forming method for forming an image on a recording medium by discharging a liquid.

DISCUSSION OF THE BACKGROUND

An image forming apparatus, such as a copying machine, a printer, a facsimile machine, a plotter, or a multifunction printer having two or more of copying, printing, scanning, and facsimile functions, forms an image on a recording medium (e.g., a sheet) by a liquid discharging method. For example, a liquid discharging head (e.g., a recording head) discharges a liquid (e.g., an ink drop) onto a conveyed sheet to form an image on the sheet.

Image forming apparatuses using the liquid discharging method include a serial type image forming apparatus and a line type image forming apparatus. In the serial type image forming apparatus, a recording head is mounted on a carriage. While the carriage moves in a main scanning direction, the recording head discharges an ink drop onto a sheet intermittently fed in a direction perpendicular to the main scanning direction (i.e., a sub-scanning direction) so as to form an image on the sheet. In the line type image forming apparatus, a plurality of recording heads are attached to a carriage in a manner that nozzles of the recording heads are arranged in a main scanning direction (i.e., a width direction of a sheet) to form a nozzle train. While a sheet is conveyed in a direction perpendicular to the main scanning direction, the recording heads discharge an ink drop onto the sheet to form an image on the sheet.

In an exemplary background image forming apparatus, a detector for detecting an inner air pressure in a recording head is provided in the recording head. An adjuster for adjusting the inner air pressure in the recording head is provided in a liquid supplier for supplying ink to the recording head. For example, the adjuster includes a pump adjusting mechanism for adjusting pumping of ink from a tank containing ink to a nozzle of the recording head. Namely, the pump adjusting mechanism adjusts a height for which ink is pumped from a liquid level in the tank up to the nozzle of the recording head. While the recording head discharges an ink drop, the inner air pressure in the recording head is measured. The adjuster is controlled to maintain the inner air pressure in the recording head in a predetermined range.

In a liquid discharging head, ink in a nozzle of the liquid discharging head needs to form a proper meniscus so as to discharge an ink drop with a stable discharging property (e.g., ink volume and ink dropping speed) and to prevent dripping of ink from the nozzle. For example, when an image forming apparatus includes a head tank (e.g., a sub tank) for supplying ink to the liquid discharging head, a negative pressure is formed in the head tank. When an image forming apparatus includes a liquid cartridge (e.g., an ink cartridge), a liquid absorber provided in the liquid cartridge forms a negative pressure.

An image forming apparatus may be located in an aircraft to provide an in-flight service such as printing and copying. However, background image forming apparatuses may not properly work in the aircraft because the background image forming apparatuses are not designed for usage in the aircraft.

For example, air pressure decreases in the aircraft as the aircraft ascends. Accordingly, outer air pressure becomes smaller than inner air pressure in a liquid discharging head. As a result, ink may drip from a nozzle of the liquid discharging head.

SUMMARY

This patent specification describes a novel image forming apparatus. One example of a novel image forming apparatus includes at least one liquid discharging head and a pressure release member. The at least one liquid discharging head is configured to discharge a liquid to form an image. The pressure release member is configured to adjust inner air pressure in the at least one liquid discharging head to be continuously equivalent to outer air pressure.

This patent specification further describes a novel image forming method. One example of a novel image forming method includes discharging a liquid with at least one liquid discharging head to form an image, and adjusting inner air pressure in the at least one liquid discharging head with a pressure release member so that the inner air pressure is continuously equivalent to outer air pressure.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
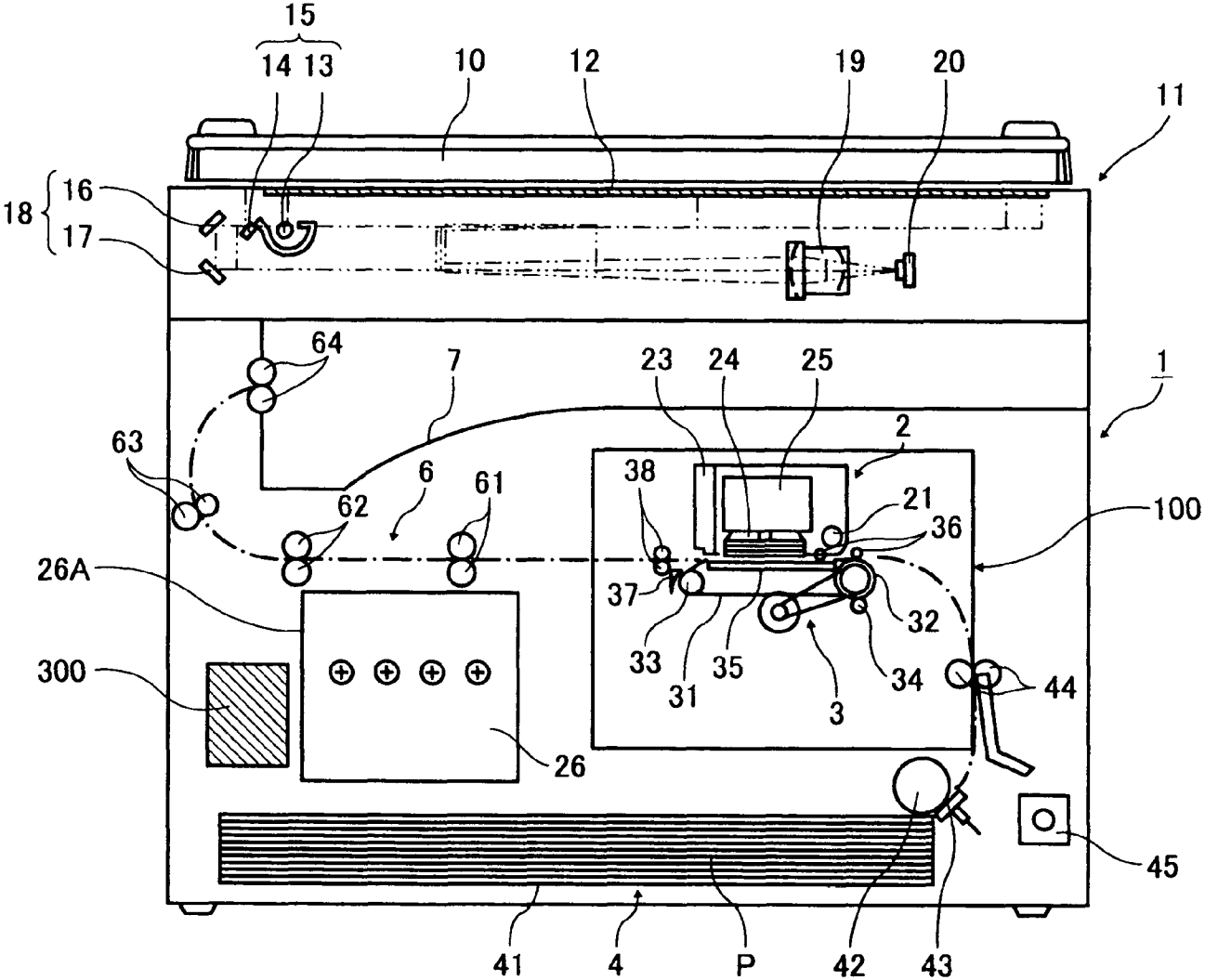
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment is explained.

As illustrated in FIG. 1, the image forming apparatus 1 includes an exposure glass cover 10, a reader 11, an engine unit 100, ink cartridges 26, a cartridge holder 26A, a paper tray unit 4, an output conveyer 6, an output tray 7, and a controller 300. The reader 11 includes an exposure glass 12, optical scanning systems 15 and 18, a lens 19, and a scanning element 20. The optical scanning system 15 includes a light source 13 and a mirror 14. The optical scanning system 18 includes minors 16 and 17. The engine unit 100 includes an image forming device 2 and a sub-scanning direction conveyer 3. The image forming device 2 includes a carriage guide 21, a carriage 23, recording heads 24, and head tanks 25. The sub-scanning direction conveyer 3 includes a conveying belt 31, a conveying roller 32, a tension roller 33, a charging roller 34, a guide 35, pressing rollers 36, a separating nail 37, and a conveying roller pair 38. The paper tray unit 4 includes a paper tray 41, a feeding roller 42, a friction pad 43, a registration roller pair 44, and a feeding motor 45. The output conveyer 6 includes conveying roller pairs 61, 62, and 63 and an output roller pair 64.

The image forming apparatus 1 can be included in any of a copying machine, a printer, a facsimile machine, a plotter, and a multifunction printer including copying, printing, scanning, and facsimile functions. In this non-limiting exemplary embodiment, the image forming apparatus 1 functions as a color copying machine for forming a color image on a recording medium.

The exposure glass cover 10 is provided on the reader 11 and presses an original placed on the reader 11. The reader 11 (e.g., a scanner) is disposed in an upper portion of the image forming apparatus 1 and above the output tray 7, and scans an image on the original to generate image data (e.g., print data). The engine unit 100 has a structure unitizing the image forming device 2 with the sub-scanning direction conveyer 3, and is attachable to and detachable from the image forming apparatus 1. The image forming device 2 forms an image on a recording medium according to the image data generated by the reader 11. The paper tray unit 4 loads a recording medium (e.g., a plurality of sheets P), which is not limited to paper. The paper tray unit 4 is disposed in a bottom portion of the image forming apparatus 1. The paper tray unit 4 separates an uppermost sheet P from the other sheets P to feed the sheets P one by one towards the sub-scanning direction conveyer 3. The sub-scanning direction conveyer 3 turns a direction in which a sheet P fed from the paper tray unit 4 is conveyed by about 90 degrees so that the sheet P opposes the image forming device 2, and conveys the sheet P towards the output conveyer 6. For example, the image forming device 2 discharges a liquid (e.g., an ink drop) onto a sheet P at an opposing position at which the image forming device 2 opposes the sub-scanning direction conveyer 3, while the sheet P is intermittently conveyed by the sub-scanning direction conveyer 3. The output conveyer 6 conveys the sheet P towards the output tray 7. The output tray 7 is disposed in the upper portion of the image forming apparatus 1, and receives the sheet P conveyed by the output conveyer 6.

In the reader 11, an original having an image thereon is placed on the exposure glass 12 facing down. The exposure glass cover 10 is provided on the exposure glass 12 and presses the original towards the exposure glass 12. The optical scanning systems 15 and 18 move and scan the image on the original. The light source 13 irradiates light onto the original placed on the exposure glass 12. The mirror 14 deflects the light reflected by the original towards the mirror 16. The mirror 16 further deflects the light deflected by the mirror 14 towards the mirror 17. The mirror 17 further deflects the light deflected by the mirror 16 towards the lens 19. The lens 19 irradiates the light deflected by the mirror 17 towards the scanning element 20. The scanning element 20 converts the light into an image signal. The image signal is digitized and processed to generate image data.

In the image forming device 2, the carriage guide 21 (e.g., a guide rod) supports the carriage 23 together with a guide stay (not shown) in a state that the carriage 23 is movable in a main scanning direction. The carriage 23 carries the recording heads 24. The recording heads 24 serve as liquid discharging heads for discharging an ink drop onto a sheet P sent from the paper tray unit 4 according to the image data generated by the wader 11. The head tanks 25 are mounted on the carriage 23 and contain inks to be discharged from the recording heads 24, respectively.

The ink cartridges 26 contain black, cyan, magenta, and yellow inks, respectively, and are attachable to and detachable from the cartridge holder 26A disposed on a front of the image forming apparatus 1. The black, cyan, magenta, and yellow inks contained in the ink cartridges 26 are supplied to the head tanks 25 via tubes (not shown), respectively.

In the paper tray unit 4, the paper tray 41 loads a plurality of sheets P. The paper tray 41 is attachable to and detachable from the image forming apparatus 1. The feeding roller 42 and the friction pad 43 feed the sheets P from the paper tray 41 one by one towards the registration roller pair 44. The registration roller pair 44 feeds the sheet P fed by the feeding roller 42 and the friction pad 43 towards the sub-scanning direction conveyer 3. The feeding motor 45 includes a HB (hybrid) type stepping motor and serves as a driver for rotatably driving the feeding roller 42 and the registration roller pair 44 via a feeding clutch (not shown).

In the sub-scanning direction conveyer 3, the conveying belt 31 is formed in an endless belt-like shape and is looped over the conveying roller 32 and the tension roller 33. The conveying roller 32 serves as a driving roller for rotatably driving the conveying belt 31. The tension roller 33 serves as a driven roller for being rotatably driven by the conveying roller 32 via the conveying belt 31, and applies tension to the conveying belt 31. The charging roller 34 applies an alternating voltage (e.g., an alternating current bias voltage) to the conveying belt 31 to charge a surface of the conveying belt 31. The guide 35 opposes the image forming device 2 and guides the rotating conveying belt 31. The pressing rollers 36 oppose the conveying roller 32 via the conveying belt 31 and press the sheet P conveyed on the conveying belt 31 towards the conveying belt 31. The separating nail 37 separates the sheet P bearing an image formed by the image forming device 2 from the conveying belt 31. The conveying roller pair 38 feeds the sheet P separated from the conveying belt 31 towards the output conveyer 6.

In the output conveyer 6, the conveying roller pairs 61, 62, and 63 feed the sheet P bearing the image and sent from the engine unit 100 towards the output roller pair 64. The output roller pair 64 feeds the sheet P bearing the image onto the output tray 7.

The controller 300 controls operations of the image forming apparatus 1.

Figure 2:
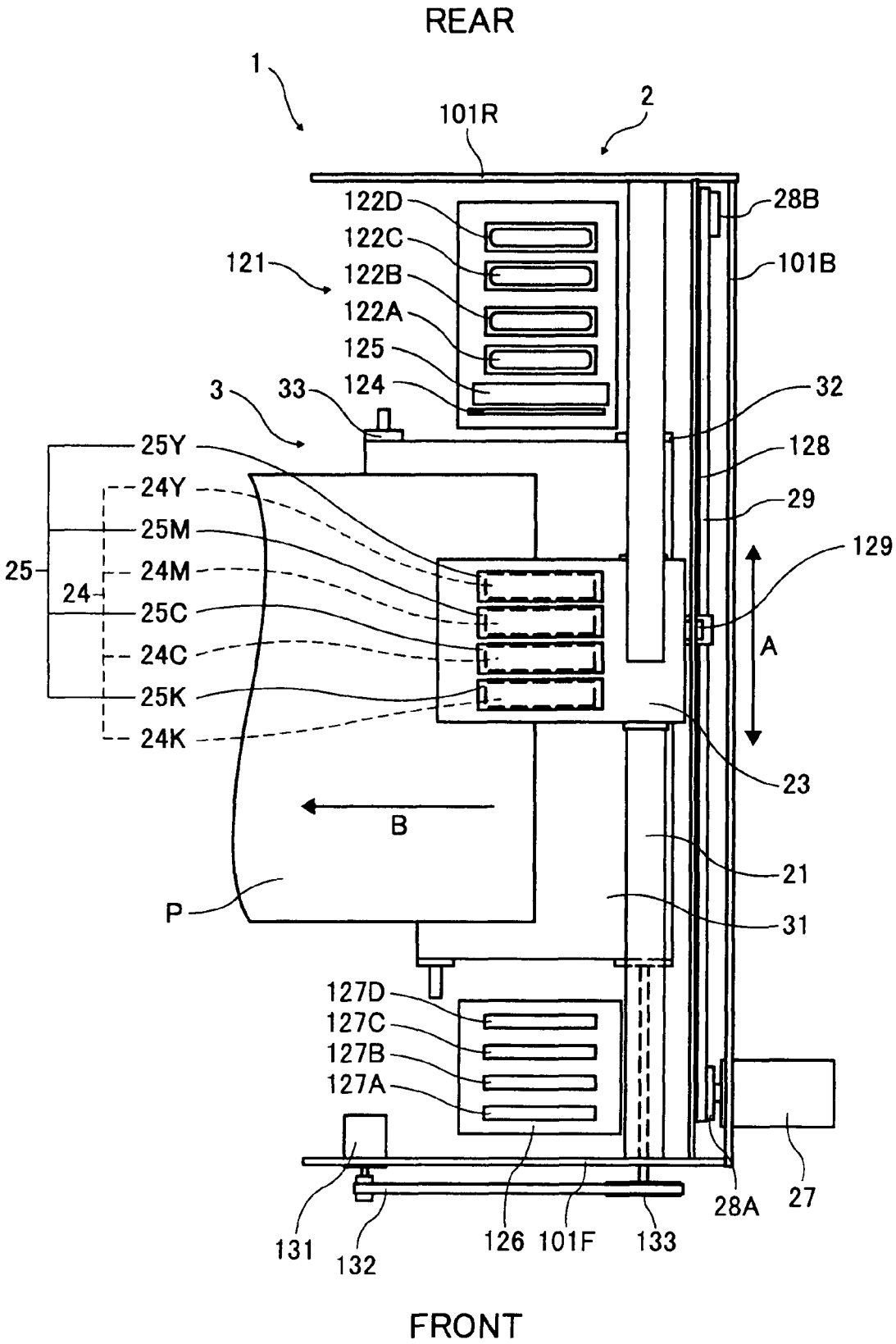
FIG. 2 is a plane view of an image forming device and a sub-scanning direction conveyer of the image forming apparatus shown in FIG. 1.

FIG. 2 is a plane view of the image forming device 2 and the sub-scanning direction conveyer 3. As illustrated in FIG. 2, the image forming device 2 further includes a timing belt 29, a driving pulley 28A, a driven pulley 28B, a main scanning motor 27, a back stay 101B, a front side plate 101F, a rear side plate 101R, a linear scale 128, a photo sensor 129, a maintenance-recovery mechanism 121, and an idle discharge receiver 126. The sub-scanning direction conveyer 3 further includes a sub-scanning motor 131, a timing belt 132, and a timing roller 133. The recording heads 24 include four recording heads 24K, 24C, 24M, and 24Y. The head tanks 25 include head tanks 25K, 25C, 25M, and 25Y. The maintenance-recovery mechanism 121 includes caps 122A, 122B, 122C, and 122D, a wiper blade 124, and an idle discharge receiver 125. The idle discharge receiver 126 includes openings 127A, 127B, 127C, and 127D.

The timing belt 29 is looped over the driving pulley 28A and the driven pulley 28B. The main scanning motor 27 rotates the driving pulley 28A. The rotating driving pulley 28A rotates the timing belt 29. The rotating timing belt 29 rotates the driven pulley 28B. The carriage 23 is attached to the timing belt 29. Thus, the main scanning motor 27 moves the carriage 23 via the driving pulley 28A, the driven pulley 28B, and the timing belt 29 in a main scanning direction (i.e., directions A). Namely, the rotating timing belt 29 moves the carriage 23 movably supported by the carriage guide 21 and a guide stay (not shown) provided on the back stay 101B in the main scanning direction. The carriage guide 21 is bridged between the front side plate 101F and the rear side plate 101R.

The recording heads 24 are mounted on the carriage 23 and discharge an ink drop in a shuttle method. For example, while a sheet P is conveyed on the conveying belt 31 in a sub-scanning direction (i.e., a direction B), the recording heads 24 mounted on the carriage 23 and moving in the directions A discharge an ink drop onto the sheet P to form an image on the sheet P. The recording heads 24K, 24C, 24M, and 24Y discharge black, cyan, magenta, and yellow inks, respectively. The head tanks 25K, 25C, 25M, and 25Y mounted on the carriage 23 supply the black, cyan, magenta, and yellow inks to the recording heads 24K, 24C, 24M, and 24Y, respectively.

Multiple types of recording heads including piezo, thermal, and electrostatic types may be used as the recording heads 24. The piezo type recording head uses a piezoelectric element as a pressure generator (e.g., an actuator) for applying pressure on ink in an ink flow route (e.g., a pressure generating room) to deform a vibration board forming walls of the ink flow route, so that a changed volume of the ink flow route discharges an ink drop. The thermal type recording head uses a heat generating resistance body to generate a bubble by boiling ink in an ink flow route, so that pressure of the bubble discharges an ink drop. The electrostatic type recording head uses a vibration board forming walls of an ink flow route and an electrode, which oppose each other, so that the vibration board deformed by an electrostatic force generated between the vibration board and the electrode changes a volume of the ink flow route and discharges an ink drop. The recording heads 24 may include one or more liquid discharging heads including a train of one or more nozzles for discharging liquid in one or more colors. According to this non-limiting exemplary embodiment, each of the recording heads 24K, 24C, 24M, and 24Y includes a nozzle for discharging a liquid drop in a single color.

The linear scale 128 (e.g., an encoder sheet) includes a slit and is stretched between the front side plate 101F and the rear side plate 101R along the main scanning direction in which the carriage 23 moves. The photo sensor 129 (e.g., a transmission photo sensor or an encoder sensor) is provided on the carriage 23 and detects the slit of the linear scale 128. The linear scale 128 and the photo sensor 129 form a linear encoder for detecting movement of the carriage 23.

The maintenance-recovery mechanism 121 is disposed in a non-printing area near one end of the carriage guide 21 in the main scanning direction in which the carriage 23 moves. The maintenance-recovery mechanism 121 maintains and recovers conditions of the nozzles of the recording heads 24. The caps 122A, 122B, 122C, and 122D cap the nozzles of the recording heads 24K, 24C, 24M, and 24Y, respectively. The cap 122A moisturizes the nozzle and sucks ink from the nozzle. The caps 122B, 122C, and 122D moisturize the nozzles, respectively. The wiper blade 124 wipes the nozzles of the recording heads 24. The idle discharge receiver 125 receives an ink drop discharged from the recording heads 24 during idle discharge and not used for printing.

The idle discharge receiver 126 is disposed in another non-printing area near the other end of the carriage guide 21 in the main scanning direction in which the carriage 23 moves. The openings 127A, 127B, 127C, and 127D receive ink drops discharged from the recording heads 24 during idle discharge and not used for printing.

The sub-scanning motor 131 rotates the timing belt 132. The rotating timing belt 132 rotates the timing roller 133. The rotating timing roller 133 rotates the conveying roller 32. The rotating conveying roller 32 rotates the conveying belt 31 in a sheet conveyance direction (i.e., the subscanning direction or the direction B).

Figure 3:
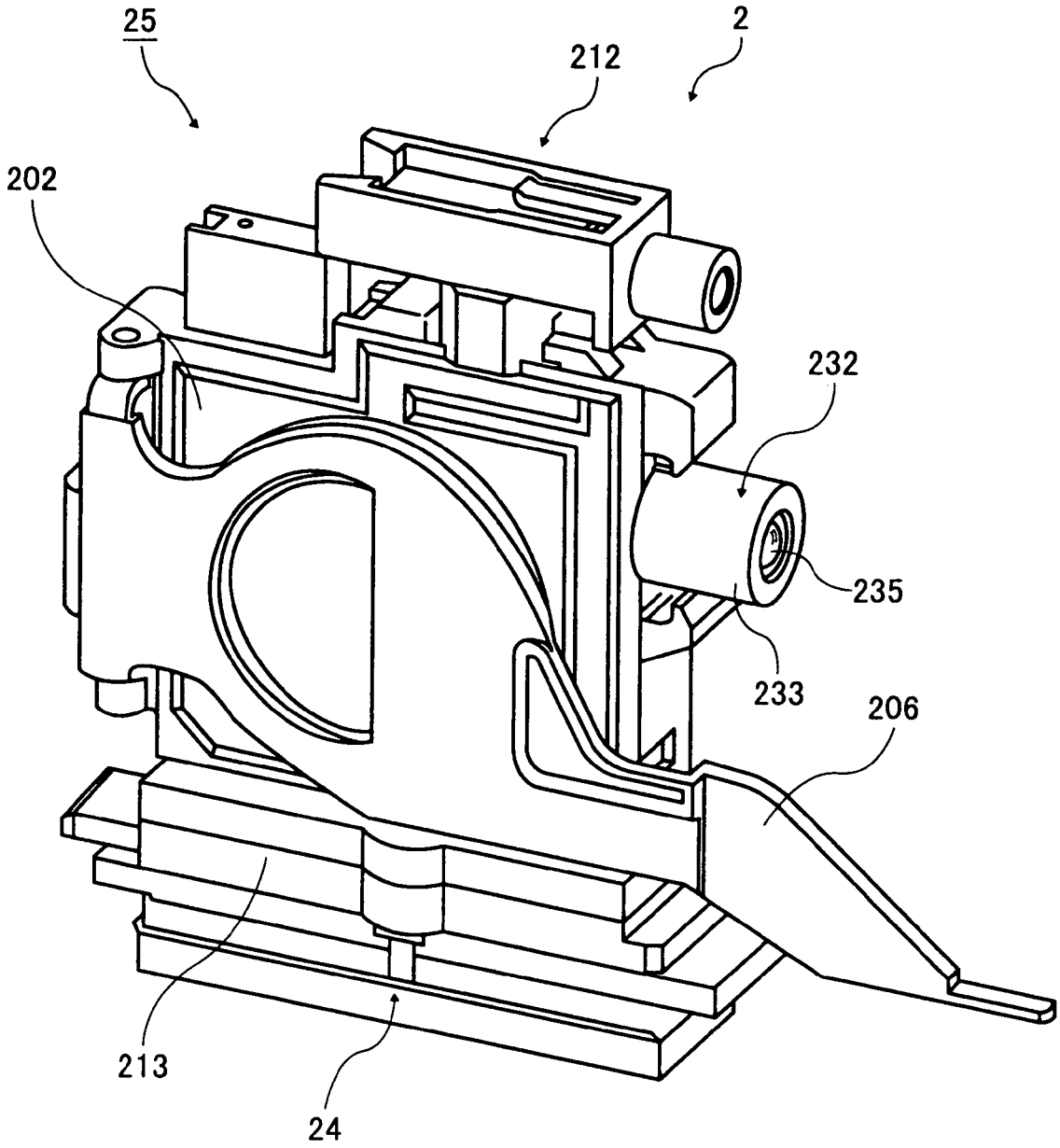
FIG. 3 is a perspective view of a head tank of the image forming device shown in FIG. 2.
Figure 4:
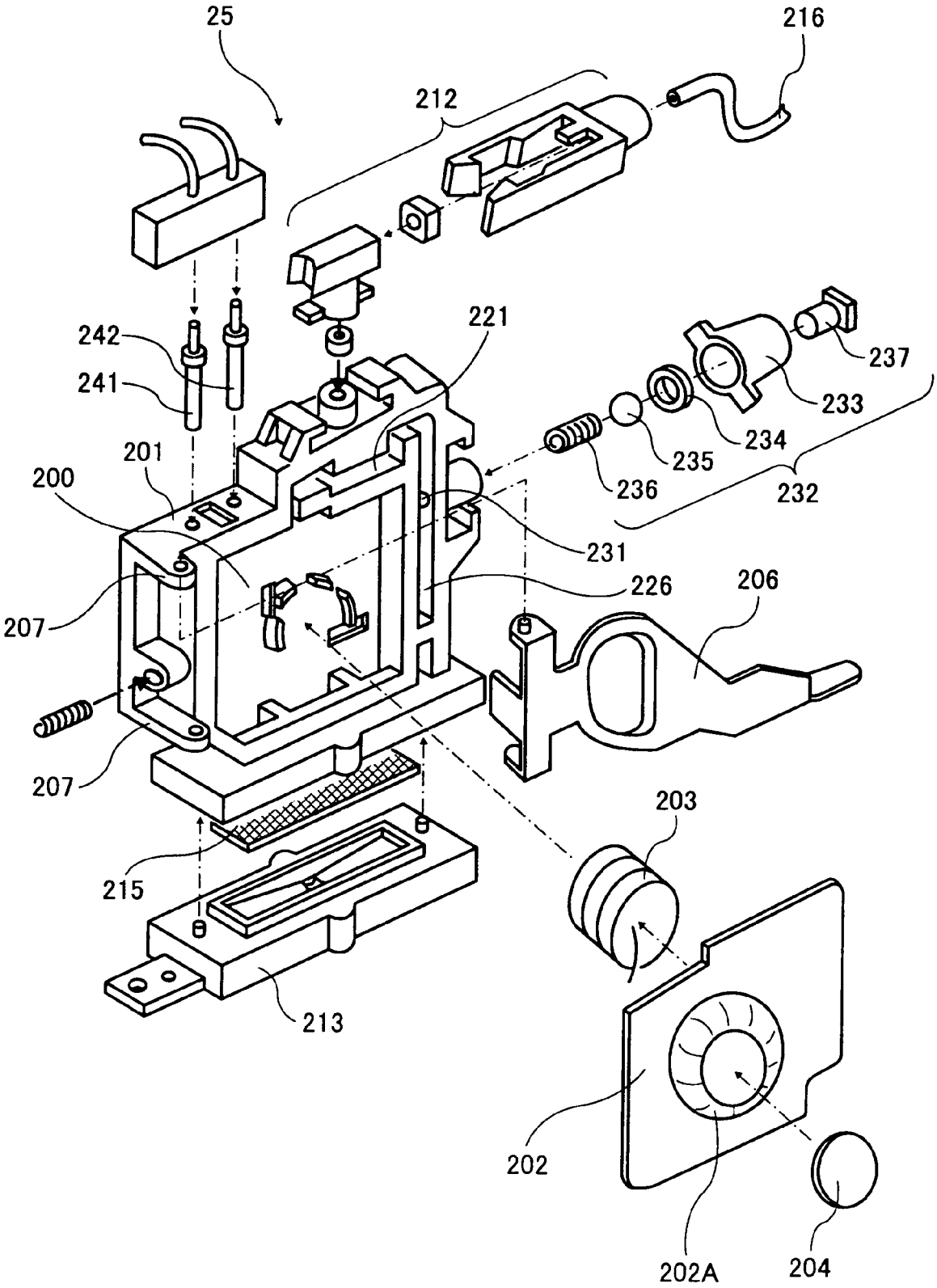
FIG. 4 is an exploded perspective view of the head tank shown in FIG. 3.
Figure 5:
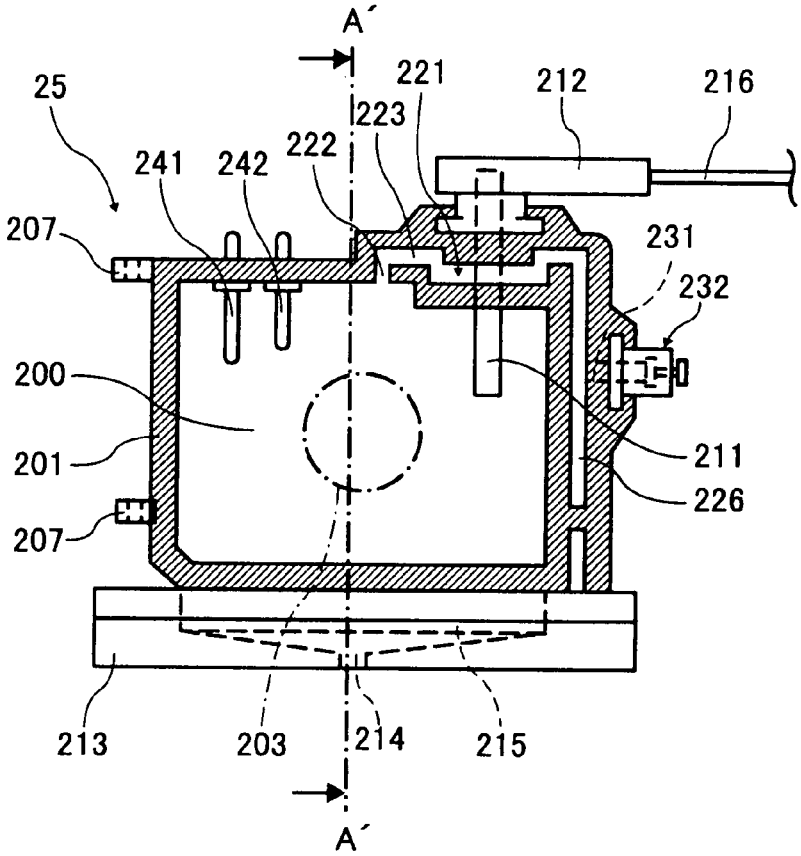
FIG. 5 is a schematic side view of the head tank shown in FIG. 3.
Figure 6:
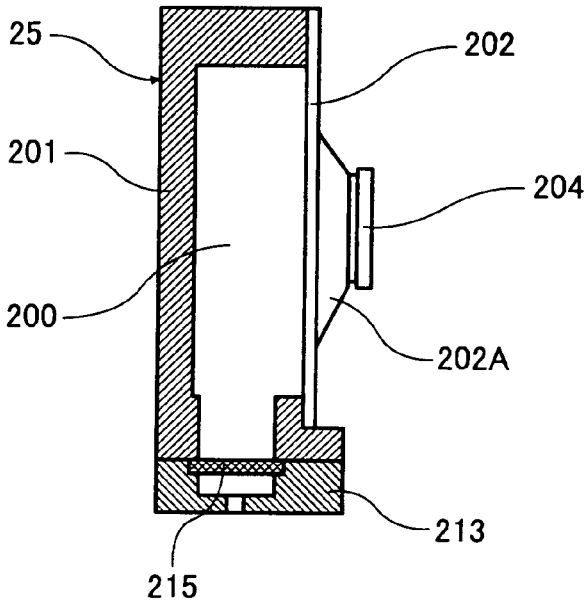
FIG. 6 is a schematic sectional view of the head tank taken on line A'-A' shown in FIG. 5.

Referring to FIGS. 3 to 6, the following describes one example of the head tank 25. FIG. 3 is a perspective view of the head tank 25. FIG. 4 is an exploded perspective view of the head tank 25. FIG. 5 is a schematic side view of the head tank 25. FIG. 6 is a schematic sectional view of the head tank 25 taken on line A'-A' shown in FIG. 5.

As illustrated in FIG. 4, the head tank 25 (e.g., the head tank 25K, 25C, 25M, or 25Y depicted in FIG. 2) includes an ink container 200, a case 201, a film member 202, an elastic member 203, a bulge 202A, a reinforcing member 204, a full detecting lever 206, supports 207, an ink tube 216, connectors 212 and 213, a filter 215, an air flow path 221, an air release opening 231, a storage 226, an air release mechanism 232, and detecting electrodes 241 and 242. The air release mechanism 232 includes a holder 233, a valve seat 234, a ball 235, a spring 236, and a pressing member 237.

As illustrated in FIG. 5, the head tank 25 further includes an ink input path 211 and an ink output path 214. The air flow path 221 includes an entrance path 222 and a flow path 223.

As illustrated in FIG. 4, the ink container 200 contains ink. The case 201 forms the ink container 200. The film member 202 has flexibility and is attached (e.g., adhered or welded) to the case 201 to seal an opening of the ink container 200. The elastic member 203 (e.g., a spring) is provided between the case 201 and the film member 202 to apply a force to the film member 202 in a direction separating the film member 202 away from the case 201. The bulge 202A is formed on the film member 202 to correspond to the elastic member 203. The reinforcing member 204 is attached to an outer surface of the bulge 202A.

The full detecting lever 206 detects a full condition in which the ink container 200 is full of ink. The supports 207 are provided on one side of the case 201 and swingably support the full detecting lever 206.

As illustrated in FIG. 5, the ink input path 211 is provided in the case 201 and guides ink to the ink container 200. The ink tube 216 is connected to the ink cartridge 26 (depicted in FIG. 1). The connector 212 connects the ink tube 216 with the ink input path 211, and is attachable to and detachable from the ink input path 211.

The connector 213 is attached to a bottom of the case 201 and supplies ink from the ink container 200 to the recording head 24 (depicted in FIG. 3). The ink output path 214 is provided in the connector 213 and guides ink from the ink container 200 to the recording head 24. The filter 215 is provided between the ink container 200 and the connector 213.

The air flow path 221 is provided in an upper portion of the case 201 and conveys air from the ink container 200. The entrance path 222 includes an opening connected to the ink container 200. The flow path 223 is provided downstream from the entrance path 222 in an air conveyance direction. A downstream portion of the flow path 223 is connected to the air release opening 231 provided in the case 201. The storage 226 is disposed at a position lower than the air release opening 231.

As illustrated in FIG. 4, the air release mechanism 232 is provided in the air release opening 231. In the air release mechanism 232, the holder 233 holds the valve seat 234, the ball 235, and the spring 236. The spring 236 applies a force to the ball 235, serving as a valve disc, in a direction in which the ball 235 contacts the valve seat 234. The pressing member 237 applies a pressure to the ball 235.

The two detecting electrodes 241 and 242 are attached to the upper portion of the case 201 and detect whether the ink container 200 is empty or almost empty.

When the pressing member 237 presses the ball 235, the air release opening 231 is opened so that air in the ink container 200 is released through the air flow path 221 and the air release opening 231. Thus, ink is pressingly conveyed from the ink cartridge 26 (depicted in FIG. 1) to the head tank 25. As a result, the head tank 25 is replenished with ink. Accordingly, air in the head tank 25 is output through the air flow path 221 and the air release mechanism 232.

When the air release mechanism 232 closes the air release opening 231, air in the ink container 200 is not released. Simultaneously, the cap 122A (depicted in FIG. 2) caps the recording head 24 (depicted in FIG. 2). Thus, ink in the head tank 25 is sucked via the nozzle of the recording head 24. Since the elastic member 203 applies a force to the film member 202, a negative pressure generates in the head tank 25.

The negative pressure generated in the head tank 25 is applied to the recording head 24. A meniscus is formed at a reference position in the nozzle of the recording head 24, resulting in a stable ink discharge.

Figure 7:
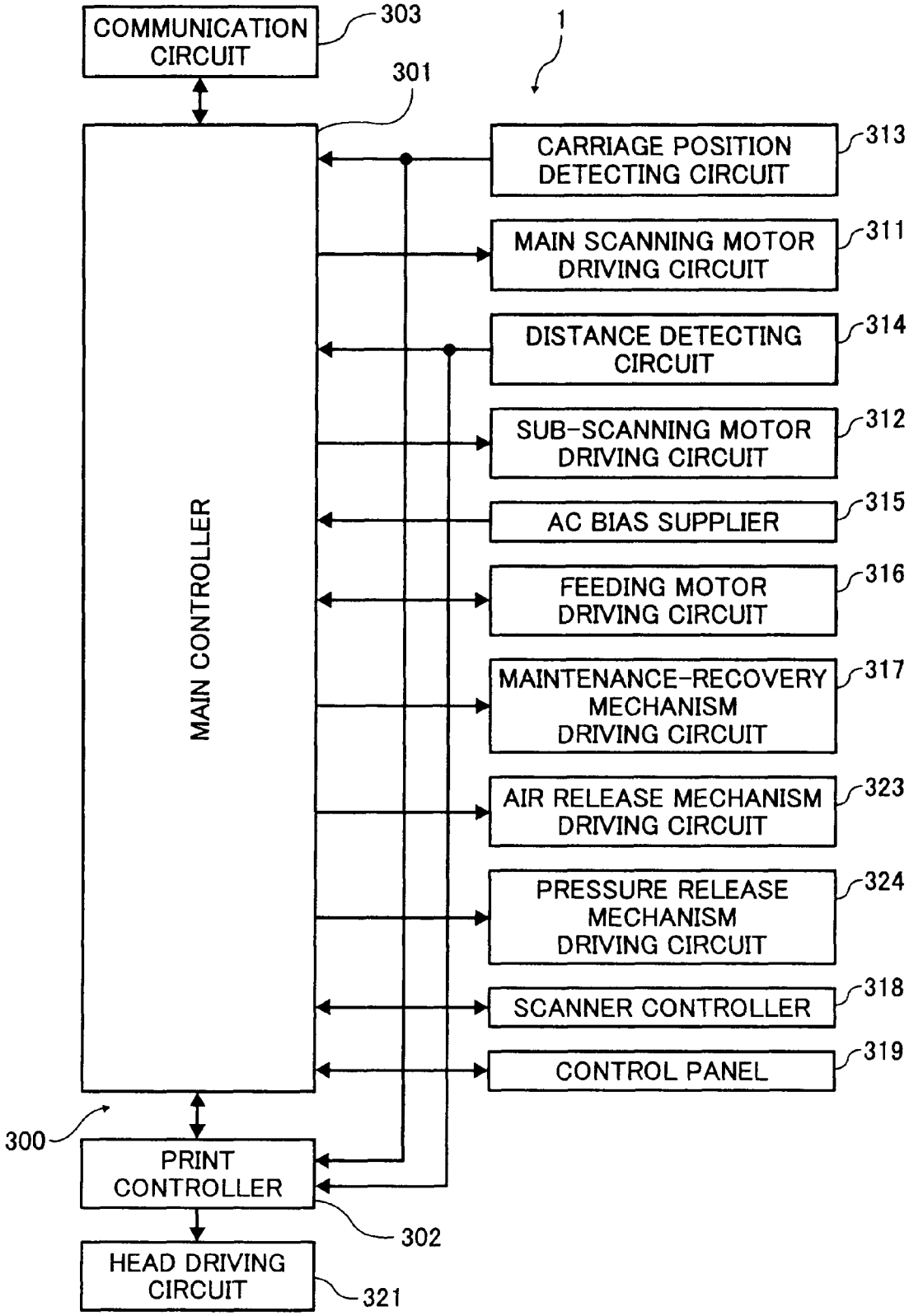
FIG. 7 is a block diagram of a controller of the image forming apparatus shown in FIG. 1.

Referring to FIG. 7, the following describes the controller 300. As illustrated in FIG. 7, the image forming apparatus 1 further includes a communication circuit 303, a main scanning motor driving circuit 311, a sub-scanning motor driving circuit 312, a carriage position detecting circuit 313, a distance detecting circuit 314, an AC (alternating current) bias supplier 315, a feeding motor driving circuit 316, a maintenance-recovery mechanism driving circuit 317, a scanner controller 318, a control panel 319, an air release mechanism driving circuit 323, a pressure release mechanism driving circuit 324, and a head driving circuit 321. The controller 300 includes a main controller 301 and a print controller 302.

The main controller 301 includes a microcomputer for controlling overall operations of the image forming apparatus 1. The microcomputer includes a CPU (central processing unit), a ROM (read-only memory), a RAM (random-access memory), a VRAM (video random-access memory), and an I/O (input output). The print controller 302 includes a microcomputer for controlling print operations of the image forming apparatus 1.

The communication circuit 303 sends information about print processing to the main controller 301. The main scanning motor driving circuit 311 drives the main scanning motor 27 (depicted in FIG. 2). The sub-scanning motor driving circuit 312 drives the sub-scanning motor 131 (depicted in FIG. 2). The main controller 301 controls driving of the main scanning motor 27 and the sub-scanning motor 131 via the main scanning motor driving circuit 311 and the sub-scanning motor driving circuit 312, respectively, so as to form an image on a sheet P based on the information about print processing sent from the communication circuit 303. The main controller 301 sends print data to the print controller 302.

The carriage position detecting circuit 313 detects a position of the carriage 23 (depicted in FIG. 2) and sends a detection signal corresponding to the detected position to the main controller 301. The main controller 301 controls movement (e.g., a position to which the carriage 23 moves and a moving speed of the carriage 23) of the carriage 23 based on the detection signal. For example, the carriage position detecting circuit 313 detects the position of the carriage 23 by calculating the number of slits provided on the linear scale 128 (depicted in FIG. 2) disposed along the main scanning direction in which the carriage 23 moves. The photo sensor 129 (depicted in FIG. 2) mounted on the carriage 23 reads the slits. The main scanning motor driving circuit 311 rotatably drives the main scanning motor 27 in accordance with an output value sent from the main controller 301 and corresponding to a moving distance of the carriage 23 so as to move the carriage 23 to a predetermined position at a predetermined speed. The output value includes a PWM (pulse width modulation) output value when PWM control is performed.

The distance detecting circuit 314 detects a moving distance of the conveying belt 31 (depicted in FIG. 2) and sends a detection signal corresponding to the detected distance to the main controller 301. The main controller 301 controls movement (e.g., a moving distance and a moving speed) of the conveying belt 31 based on the detection signal. For example, the distance detecting circuit 314 detects the moving distance of the conveying belt 31 by calculating the number of slits provided on an encoder wheel (not shown) attached to a shaft of the conveying roller 32 (depicted in FIG. 2). A photo sensor (not shown), such as an encoder sensor, reads the slits. The sub-scanning motor driving circuit 312 rotatably drives the sub-scanning motor 131 in accordance with the moving distance sent from the main controller 301 so as to rotate the conveying roller 32. The rotating conveying roller 32 moves the conveying belt 31 to a predetermined position at a predetermined speed.

The main controller 301 controls charging of the conveying belt 31 via the AC bias supplier 315 for applying an alternating current bias to the charging roller 34 (depicted in FIG. 1). The main controller 301 controls driving of the feeding motor 45 (depicted in FIG. 1) via the feeding motor driving circuit 316 for rotatably driving the feeding motor 45. The main controller 301 controls driving of a motor (not shown) for driving the maintenance-recovery mechanism 121 (depicted in FIG. 2) via the maintenance-recovery mechanism driving circuit 317 for rotatably driving the motor. For example, the motor lifts and lowers the caps 122A, 122B, 122C, and 122D and the wiper blade 124 (depicted in FIG. 2), and drives a sucking pump (not shown).

The main controller 301 controls driving of the reader 11 (depicted in FIG. 1) via the scanner controller 318 for driving the reader 11. The main controller 301 sends information to be displayed on the control panel 319 to the control panel 319 and receives information specified by a user on the control panel 319 from the control panel 319.

The main controller 301 controls driving of a driver (e.g., a solenoid and a motor) of an air release driving mechanism (described below) via the air release mechanism driving circuit 323. The air release mechanism driving circuit 323 drives the air release driving mechanism for opening and closing the air release mechanism 232 of each of the head tanks 25 (depicted in FIG. 4). The main controller 301 controls driving of a driver (e.g., a solenoid and a motor) of a pressure release mechanism (described below) via the pressure release mechanism driving circuit 324. The pressure release mechanism driving circuit 324 drives the pressure release mechanism for opening and closing the air release mechanism 232 of each of the four head tanks 25.

The print controller 302 generates data for driving a pressure generator (not shown) for causing the recording head 24 to discharge an ink drop based on a signal sent from the main controller 301, the position of the carriage 23 detected by the carriage position detecting circuit 313, and the moving distance of the conveying belt 31 detected by the distance detecting circuit 314. The print controller 302 transfers the image data as serial data to the head driving circuit 321. For example, the print controller 302 sends a transfer clock for transferring the image data and confirming transfer of the image data, a latch signal, and an ink control signal (e.g., a mask signal) to the head driving circuit 321. The print controller 302 includes a driving wave generator (not shown) and a driving wave selector (not shown). The driving wave generator includes a D/A (digital-analog) converter (not shown) for performing digital-analog conversion on pattern data of a driving signal stored in the ROM, a voltage amplifier (not shown), and a current amplifier (not shown). The driving wave selector selects a driving wave sent to a head driver (not shown). Namely, the print controller 302 generates a driving wave formed of one or more driving pulses (e.g., driving signals) and sends the driving wave to the head driving circuit 321.

The head driving circuit 321 drives the recording head 24 by selectively applying a driving signal to a driving element (e.g., the piezoelectric element described above). The driving signal forms a driving wave provided by the print controller 302 based on image data serially input and corresponding to one line image formed by ink drops discharged by the recording head 24. The driving element generates energy for causing the recording head 24 to discharge an ink drop. A driving pulse forming a driving wave may be selected to cause the recording head 24 to selectively discharge ink drops (e.g., dots) of different sizes. For example, the recording head 24 may discharge a large ink drop (e.g., a large dot), a medium ink drop (e.g., a medium dot), or a small ink drop (e.g., a small dot).

An amount of rotation of the conveying roller 32 for driving the conveying belt 31 is detected so as to control driving of the sub-scanning motor 131 based on the detected amount. The AC bias supplier 315 applies an alternating voltage (i.e., a square-wave, high voltage having positive and negative polarities) to the charging roller 34. Electric charges having positive and negative polarities are alternately applied to the conveying belt 31 to form strips in the sheet conveyance direction of the conveying belt 31. The conveying belt 31 is charged in a predetermined charging width to form an uneven electric field.

As illustrated in FIG. 1, a sheet P is fed from the paper tray unit 4 towards a nip formed between the conveying roller 32 and the pressing roller 36 via the conveying belt 31. The pressing roller 36 and the conveying roller 32 feed the sheet P onto the conveying belt 31 where electric charges having positive and negative polarities form an uneven electric field. The sheet P is instantly polarized in accordance with directions of the electric field. The rotating conveying belt 31 electrostatically attracts and conveys the sheet P.

While the conveying belt 31 intermittently conveys the sheet P, the recording heads 24 discharge ink drops onto the sheet P to form an image on the sheet P. When the separating nail 37 touches a foremost head of the sheet P, the separating nail 37 separates the sheet P from the conveying belt 31 and the conveying roller pair 38 feeds the sheet P towards the output conveyer 6.

As illustrated in FIG. 2, when the image forming device 2 is in a standby mode and thereby does not perform a print operation, the carriage 23 is moved to the maintenance-recovery mechanism 121 and the caps 122A, 122B, 122C, and 122D cap the nozzles of the recording heads 24 to enable the nozzles to retain moisture, respectively. Thus, inks in the nozzles are not dried, preventing a faulty discharge of inks. When the cap 122A for moisturizing the nozzles and sucking ink from the nozzles caps the recording heads 24, viscous ink and bubbles are sucked from the nozzles in a recovery operation. The wiper blade 124 wipes the nozzles of the recording heads 24 to remove inks adhered to the nozzles during the recovery operation. The recording heads 24 discharge ink not used for the print operation towards the idle discharge receiver 125 before and during the print operation. Thus, the recording heads 24 may maintain a stable discharging performance.

Referring to FIGS. 8 to 13, the following describes an air release driving mechanism and a pressure release mechanism according to an exemplary embodiment.

Figure 8:
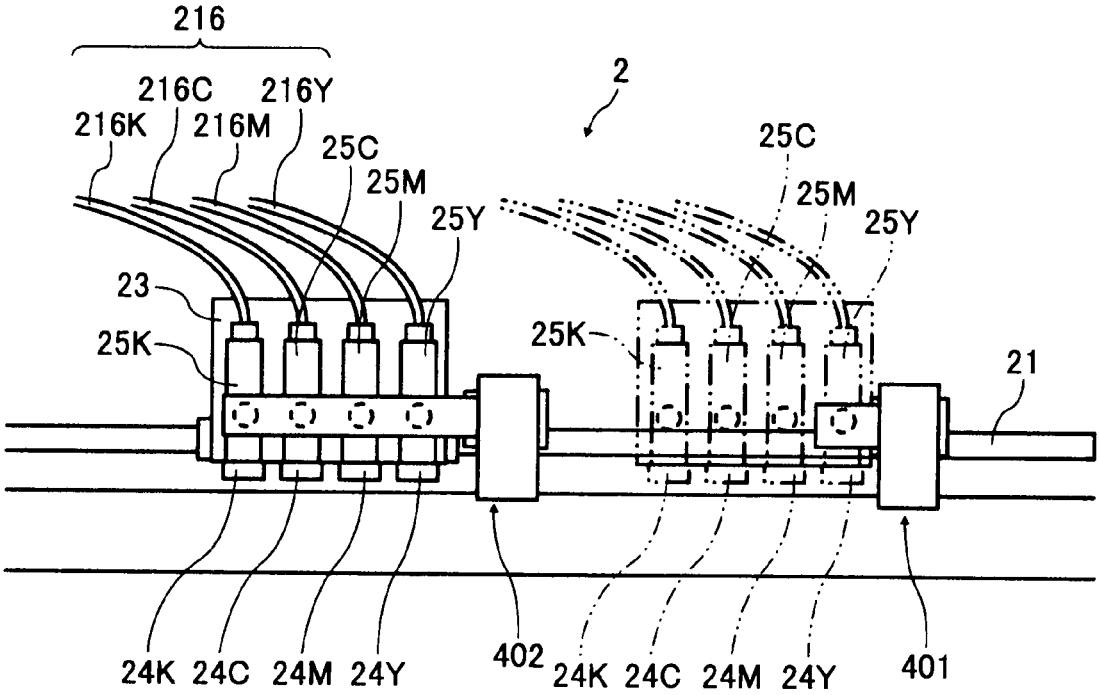
FIG. 8 is a top view of an air release driving mechanism and a pressure release mechanism of the image forming device shown in FIG. 2.

As illustrated in FIG. 8, the image forming device 2 further includes an air release driving mechanism 401 and a pressure release mechanism 402. The ink tube 216 includes ink tubes 216K, 216C, 216M, and 216Y.

The air release driving mechanism 401 drives the air release mechanism 232 (depicted in FIG. 4) provided in each of the head tanks 25K, 25C, 25M, and 25Y. The pressure release mechanism 402, serving as a pressure release member, drives the air release mechanisms 232 provided in the head tanks 25K, 25C, 25M, and 25Y, collectively or simultaneously. The air release driving mechanism 401 and the pressure release mechanism 402 are disposed at positions different from each other in the main scanning direction in which the carriage 23 moves. The air release driving mechanism 401 is disposed near the maintenance-recovery mechanism 121 (depicted in FIG. 2). The ink tubes 216K, 216C, 216M, and 216Y are connected to the ink cartridges 26 (depicted in FIG. 1) and convey black, cyan, magenta, and yellow inks to the ink containers 200 (depicted in FIG. 4) included in the head tanks 25K, 25C, 25M, and 25Y, respectively.

Figure 9:
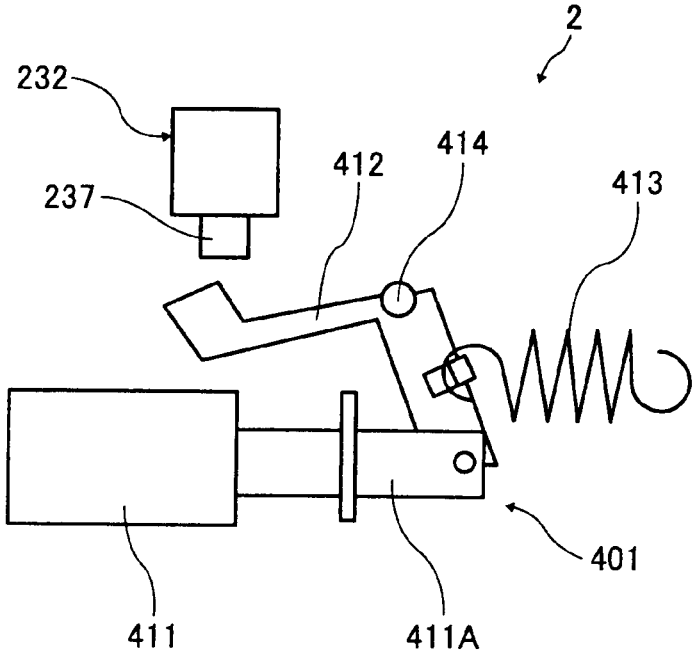
FIG. 9 is a plane view of the air release driving mechanism shown in FIG. 8.

FIG. 9 is a plane view of the air release driving mechanism 401. As illustrated in FIG. 9, the air release driving mechanism 401 includes a solenoid 411, a support shaft 414, an air release lever 412, and a spring 413. The solenoid 411 includes a plunger 411A.

The solenoid 411 serves as a driver. The support shaft 414 rotatably supports the air release lever 412. One end of the air release lever 412 is rotatably connected with the plunger 411A. The spring 413 maintains the air release lever 412 at a position that does not contact the pressing member 237 of the air release mechanism 232. Namely, the spring 413 closes the air release mechanism 232.

Figure 10:
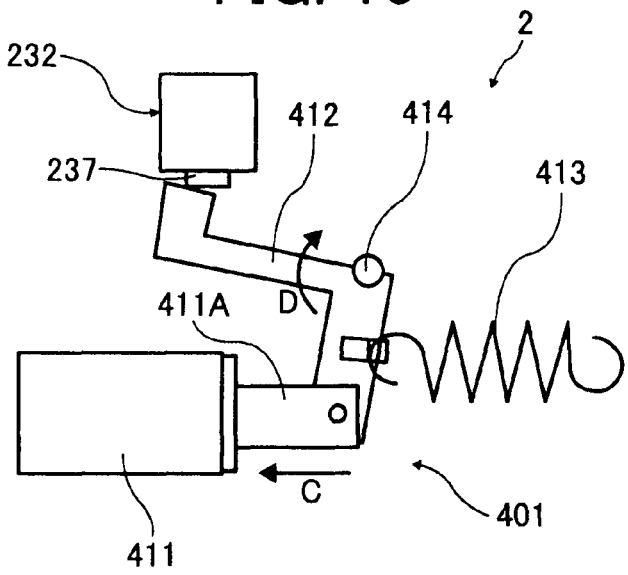
FIG. 10 is a plane view of the air release driving mechanism shown in FIG. 9 during an air release operation.

As illustrated in FIG. 8, to replenish the head tank 25Y with a yellow ink when air is released, for example, the carriage 23 moves to a position illustrated in a broken line. Accordingly, the head tank 25Y moves to a position corresponding to the air release lever 412 (depicted in FIG. 9) of the air release driving mechanism 401. As illustrated in FIG. 10, the solenoid 411 is driven to pull the plunger 411A in a direction C. Accordingly, the air release lever 412 rotates in a rotating direction D. The rotating air release lever 412 presses the pressing member 237 of the air release mechanism 232.

Figure 11A:
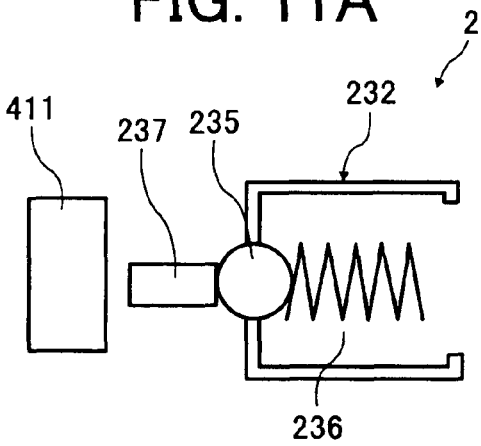
FIG. 11A is a sectional view of an air release mechanism of the head tank shown in FIG. 4.
Figure 11B:
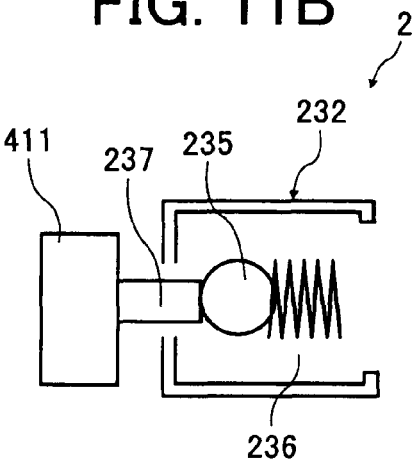
FIG. 11B is a sectional view of the air release mechanism shown in FIG. 11A during an air release operation.

As a result, the ball 235, which closes the air release mechanism 232 as illustrated in FIG. 11A, is pressed by the pressing member 237 towards the spring 236 as illustrated in FIG. 11B. Thus, the air release mechanism 232 is released (e.g., opened) and the inside of the head tank 25Y (depicted in FIG. 8) becomes open to air. Accordingly, a yellow ink is supplied from the ink cartridge 26 (depicted in FIG. 1).

To replenish another head tank (e.g., the head tank 25K, 25C, or 25M depicted in FIG. 8) with a corresponding (e.g., black, cyan, or magenta ink), such head tank 25K, 25C, or 25M moves to a position corresponding to the air release lever 412 (depicted in FIG. 9). In the head tank 25K, 25C, or 25M, the air release mechanism 232 is released as illustrated in FIG. 11B and the inside of the head tank 25K, 25C, or 25M becomes open to air. Accordingly, a black, cyan, or magenta ink is supplied from the ink cartridge 26.

Figure 12:
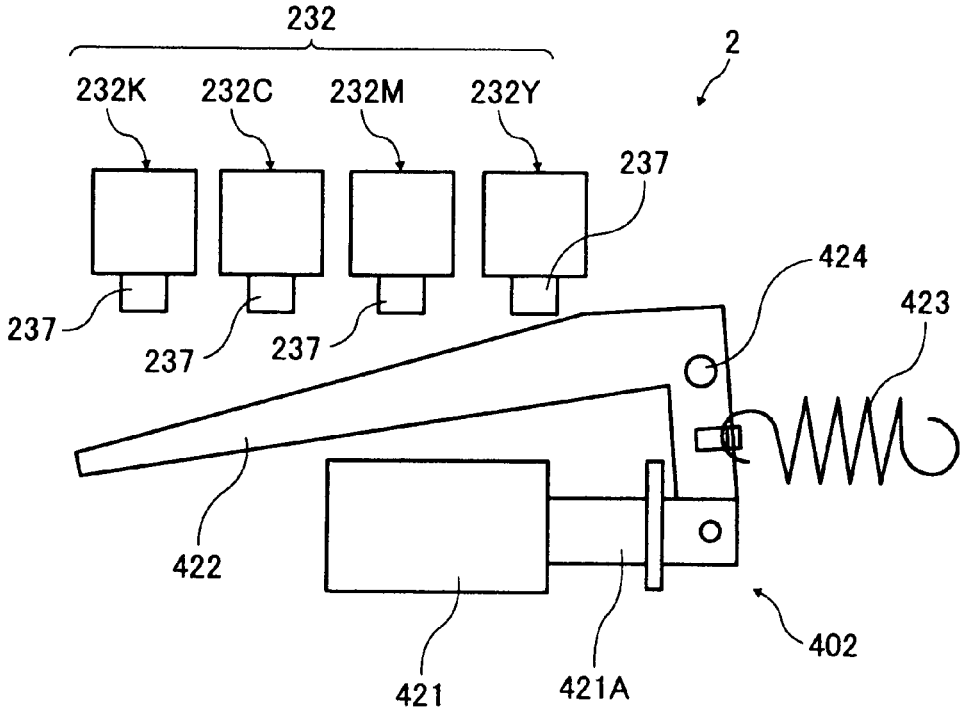
FIG. 12 is a plane view of the pressure release mechanism shown in FIG. 8.

FIG. 12 is a plane view of the pressure release mechanism 402. As illustrated in FIG. 12, the pressure release mechanism 402 includes a solenoid 421, a support shaft 424, an air release lever 422, and a spring 423. The solenoid 421 includes a plunger 421A. The air release mechanism 232 includes air release mechanisms 232K, 232C, 232M, and 232Y.

The solenoid 421 serves as a driver. The support shaft 424 rotatably supports the air release lever 422. One end of the air release lever 422 is rotatably connected with the plunger 421A. The spring 423 maintains the air release lever 422 not to contact the pressing members 237 of the air release mechanisms 232K, 232C, 232M, and 232Y, respectively. Namely, the spring 423 closes the air release mechanisms 232K, 232C, 232M, and 232Y.

The air release mechanisms 232K, 232C, 232M, and 232Y are provided in the head tanks 25K, 25C, 25M, and 25Y (depicted in FIG. 8), respectively. The air release lever 422 has a length causing the air release mechanisms 232K, 232C, 232M, and 232Y included in the head tanks 25K, 25C, 25M, and 25Y, respectively, mounted on the carriage 23 (depicted in FIG. 8) to oppose the air release lever 422.

Figure 13:
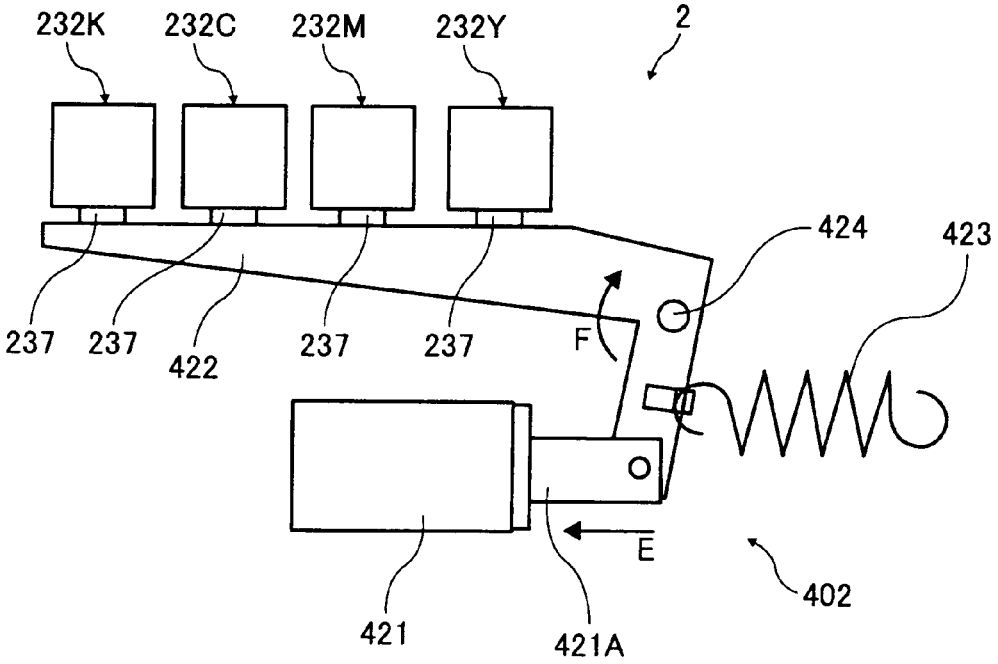
FIG. 13 is a plane view of the pressure release mechanism shown in FIG. 12 during an air release operation.

To cause inner air pressures in the head tanks 25K, 25C, 25M, and 25Y (i.e., inner air pressures in the recording heads 24K, 24C, 24M, and 24Y), respectively, to be continuously equivalent to an outer air pressure, the carriage 23 moves to a position illustrated in a solid line in FIG. 8, so that the air release mechanisms 232K, 232C, 232M, and 232Y included in the head tanks 25K, 25C, 25M, and 25Y, respectively, oppose the air release lever 422, as illustrated in FIG. 13.

As illustrated in FIG. 13, when the solenoid 421 is driven to pull the plunger 421A in a direction E, the air release lever 422 rotates in a rotating direction F. The rotating air release lever 422 presses the pressing members 237 of the air release mechanisms 232K, 232C, 232M, and 232Y, respectively. Thus, almost simultaneously, the air release mechanisms 232K, 232C, 232M, and 232Y are opened.

Accordingly, inner air pressures in the head tanks 25K, 25C, 25M, and 25Y (depicted in FIG. 8), respectively, become equivalent to an outer air pressure in an environment where the image forming apparatus 1 (depicted in FIG. 1) is located. When the image forming apparatus 1 is located in an aircraft, for example, the pressure release mechanism 402 maintains the head tanks 25K, 25C, 25M, and 25Y to continuously release air when the outer air pressure decreases as the aircraft ascends. The inner air pressures in the head tanks 25K, 25C, 25M, and 25Y, respectively, do not become relatively greater than the outer air pressure, preventing an ink drop from dripping from the nozzles of the recording heads 24 (depicted in FIG. 1).

As described above, according to this non-limiting exemplary embodiment, the image forming apparatus 1 includes a plurality of liquid discharging heads (e.g., the recording heads 24K, 24C, 24M, and 24Y depicted in FIG. 8) for discharging liquids in colors different from each other and a pressure release member (e.g., the pressure release mechanism 402 depicted in FIG. 8) for causing inner air pressures in the plurality of the liquid discharging heads, respectively, to be continuously equivalent to an outer air pressure in an environment where the image forming apparatus 1 is located. Even when the image forming apparatus 1 is located in an environment having a decreased air pressure (e.g., an aircraft or a highland), the pressure release member causes the inner air pressures in the liquid discharging heads, respectively, to be continuously equivalent to the outer air pressure in the environment. Namely, the inner air pressures in the liquid discharging heads, respectively, do not become relatively greater than the outer air pressure in the environment. As a result, an ink drop does not drip from the nozzles of the liquid discharging heads.

Figure 14:
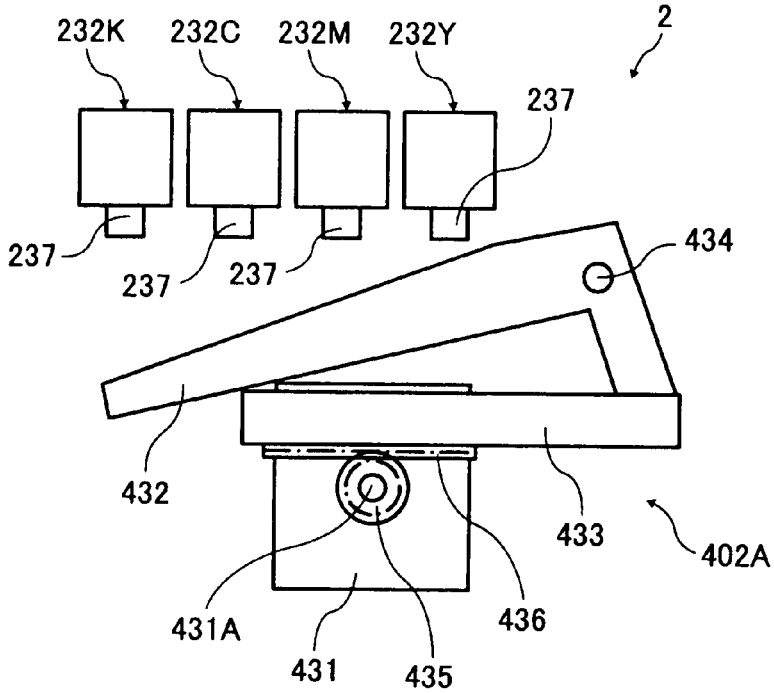
FIG. 14 is a plane view of a pressure release mechanism according to another exemplary embodiment.
Figure 15:
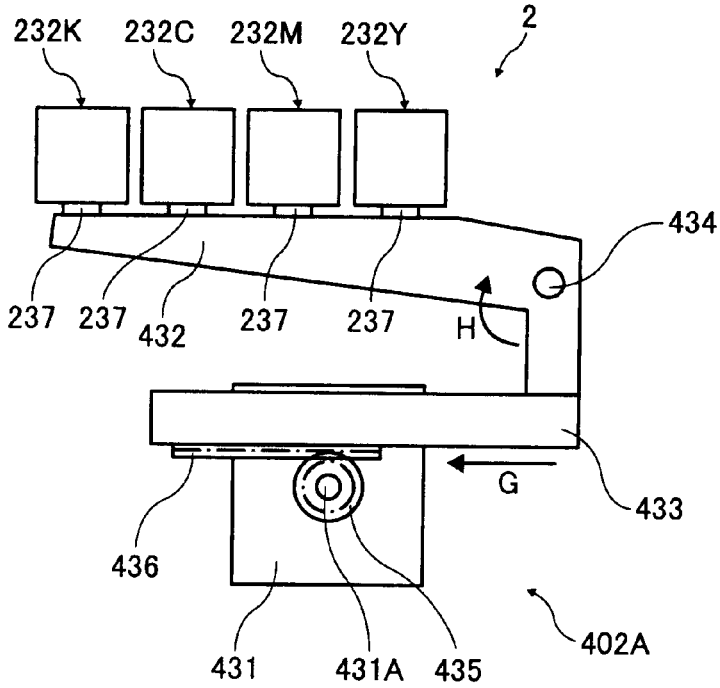
FIG. 15 is a plane view of the pressure release mechanism shown in FIG. 14 during an air release operation.

Referring to FIGS. 14 and 15, the following describes a pressure release mechanism 402A according to another exemplary embodiment. As illustrated in FIG. 14, the pressure release mechanism 402A includes a motor 431, a pinion 435, a rack 436, a moving body 433, an air release lever 432, and a support shaft 434. The motor 431 includes a rotating shaft 431A.

The pressure release mechanism 402A serves as a pressure release member. The motor 431 serves as a driver for generating a driving force. The pinion 435 is attached to the rotating shaft 431A of the motor 431. The rack 436 is attached to the moving body 433. Namely, the pinion 435 and the rack 436 convert a rotating direction of the driving force generated by the motor 431 into a straight direction for moving the moving body 433. The moving body 433 moves to swing the air release lever 432. The support shaft 434 rotatably supports the air release lever 432.

One end of the air release lever 432 rotatably supports the moving body 433. The other end of the air release lever 432 has a length such that the air release mechanisms 232K, 232C, 232M, and 232Y included in the head tanks 25K, 25C, 25M, and 25Y (depicted in FIG. 8), respectively, oppose such other end of the air release lever 432.

To cause inner air pressures in the head tanks 25K, 25C, 25M, and 25Y (i.e., inner air pressures in the recording heads 24K, 24C, 24M, and 24Y depicted in FIG. 8), respectively, to be continuously equivalent to an outer air pressure, the carriage 23 moves to a position illustrated in the solid line in FIG. 8, so that the air release mechanisms 232K, 232C, 232M, and 232Y included in the head tanks 25K, 25C, 25M, and 25Y, respectively, oppose the air release lever 432, as illustrated in FIG. 15.

As illustrated in FIG. 15, when the motor 431 is driven in a direction G to move the moving body 433 via the pinion 435 and the rack 436, the air release lever 432 rotates in a rotating direction H. The rotating air release lever 432 presses the pressing members 237 of the air release mechanisms 232K, 232C, 232M, and 232Y, respectively. Thus, almost simultaneously, the air release mechanisms 232K, 232C, 232M, and 232Y are opened.

Accordingly, inner air pressures in the head tanks 25K, 25C, 25M, and 25Y (depicted in FIG. 8), respectively, become equivalent to an outer air pressure in an environment where the image forming apparatus 1 (depicted in FIG. 1) is located. Thus, the pressure release mechanism 402A may provide effects common to the pressure release mechanism 402 (depicted in FIG. 13).

In the pressure release mechanism 402 illustrated in FIG. 13, the solenoid 421 does not move when the image forming apparatus 1 is powered off. For example, when the image forming apparatus 1 is powered off after air is released, the air release lever 422 returns to a default position illustrated in FIG. 12. Thus, air may not be continuously released. In the pressure release mechanism 402A illustrated in FIG. 15, however, the motor 431 rotates forward and backward to move the pinion 435 and the rack 436. Therefore, even when the image forming apparatus 1 is powered off after air is released, the air release lever 432 remains at an air release position at which the air release lever 432 presses the pressing members 237 of the air release mechanisms 232K, 232C, 232M, and 232Y, respectively. Thus, air may be continuously released.

In the pressure release mechanism 402 or 402A, a single, large air release lever (e.g., the air release lever 422 or 432) causes the air release mechanisms 232K, 232C, 232M, and 232Y to release air. However, an air release lever may be provided for each of the air release mechanisms 232K, 232C, 232M, and 232Y. Namely, one or more air release levers may cause the air release mechanisms 232K, 232C, 232M, and 232Y to release air, so that inner air pressures in the head tanks 25K, 25C, 25M, and 25Y, respectively, are continuously equivalent to an outer air pressure.

Figure 16:
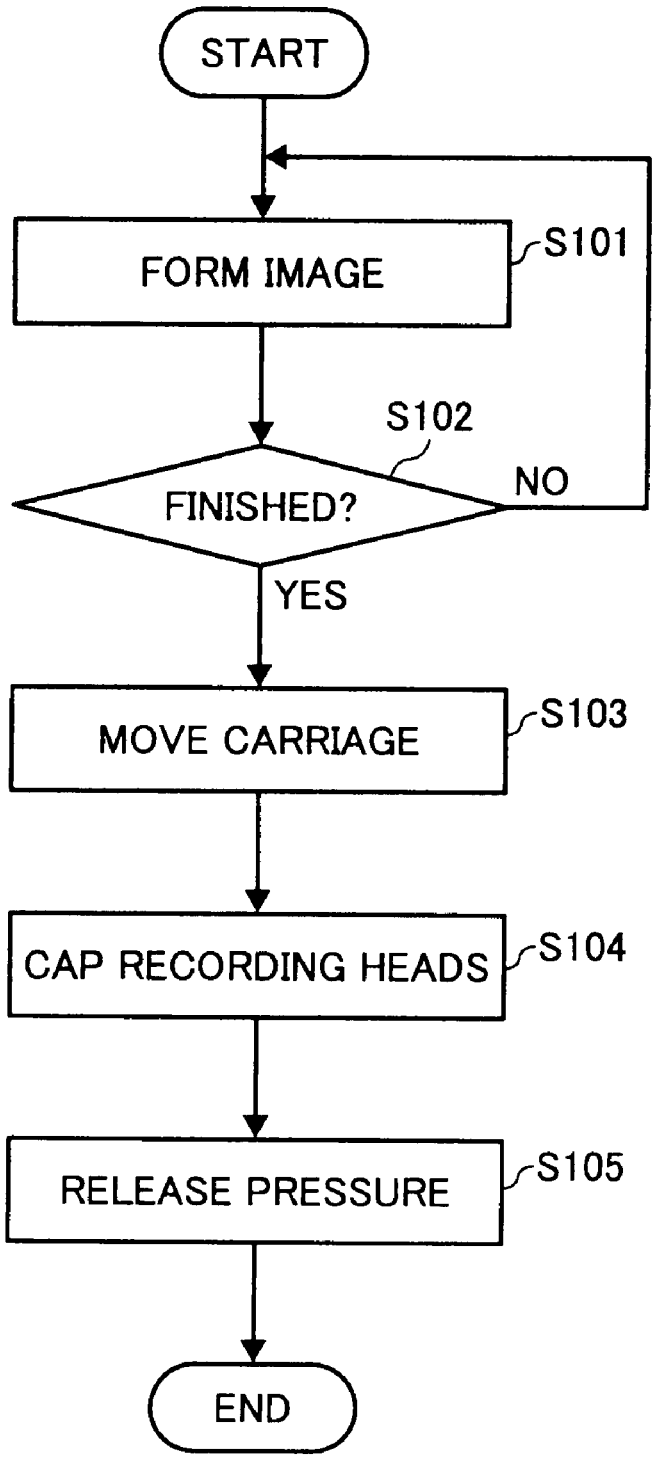
FIG. 16 is a flowchart illustrating an operation of a pressure release mechanism according to yet another exemplary embodiment.

Referring to FIG. 16, the following describes an example of operation of the pressure release mechanism 402 (depicted in FIG. 13) according to yet another exemplary embodiment FIG. 16 is a flowchart of the example of operation of the pressure release mechanism 402. According to this non-limiting exemplary embodiment, the pressure release mechanism 402 is provided near the maintenance-recovery mechanism 121 (depicted in FIG. 2). The pressure release mechanism 402A (depicted in FIG. 15) may be used instead of the pressure release mechanism 402.

In step S101, the recording heads 24K, 24C, 24M, and 24Y (depicted in FIG. 2) perform an image forming operation. For example, the recording heads 24K, 24C, 24M, and 24Y discharge an ink drop to form an image. In step S102, the controller 300 (depicted in FIG. 7) determines whether or not the image forming operation is finished. If the image forming operation is finished and thereby the image forming apparatus 1 (depicted in FIG. 1) is in a standby mode (i.e., YES is selected in step S102), the carriage 23 (depicted in FIG. 2) moves to a capping position at which the caps 122A, 122B, 122C, and 122D (depicted in FIG. 2) cap the recording heads 24K, 24C, 24M, and 24Y, respectively, in step S103. In step S104, the caps 122A, 122B, 122C, and 122D cap the recording heads 24K, 24C, 24M, and 24Y, respectively. In step S105, the pressure release mechanism 402 (depicted in FIG. 13) is activated to cause the air release mechanisms 232K, 232C, 232M, and 232Y to release air. Namely, the pressure release mechanism 402 continuously releases pressure.

When a next image forming operation starts, the head tanks 25K, 25C, 25M, and 25Y (depicted in FIG. 2) perform a negative pressure forming operation. In the negative pressure forming operation, the air release mechanisms 232K, 232C, 232M, and 232Y are closed, and the recording heads 24K, 24C, 24M, and 24Y discharge a predetermined amount of ink. Namely, an amount of ink contained in the head tanks 25K, 25C, 25M, and 25Y decreases while the head tanks 25K, 25C, 25M, and 25Y are closed. Thus, the inside of the head tanks 25K, 25C, 25M, and 25Y has a negative pressure.

As described above, in a standby mode after the image forming operation is finished, the pressure release mechanism 402 is activated to adjust inner air pressures in the plurality of the recording heads 24K, 24C, 24M, and 24Y, respectively, to be continuously equivalent to an outer air pressure, preventing an ink drop from dripping from the recording heads 24K, 24C, 24M, and 24Y.

Figure 17:
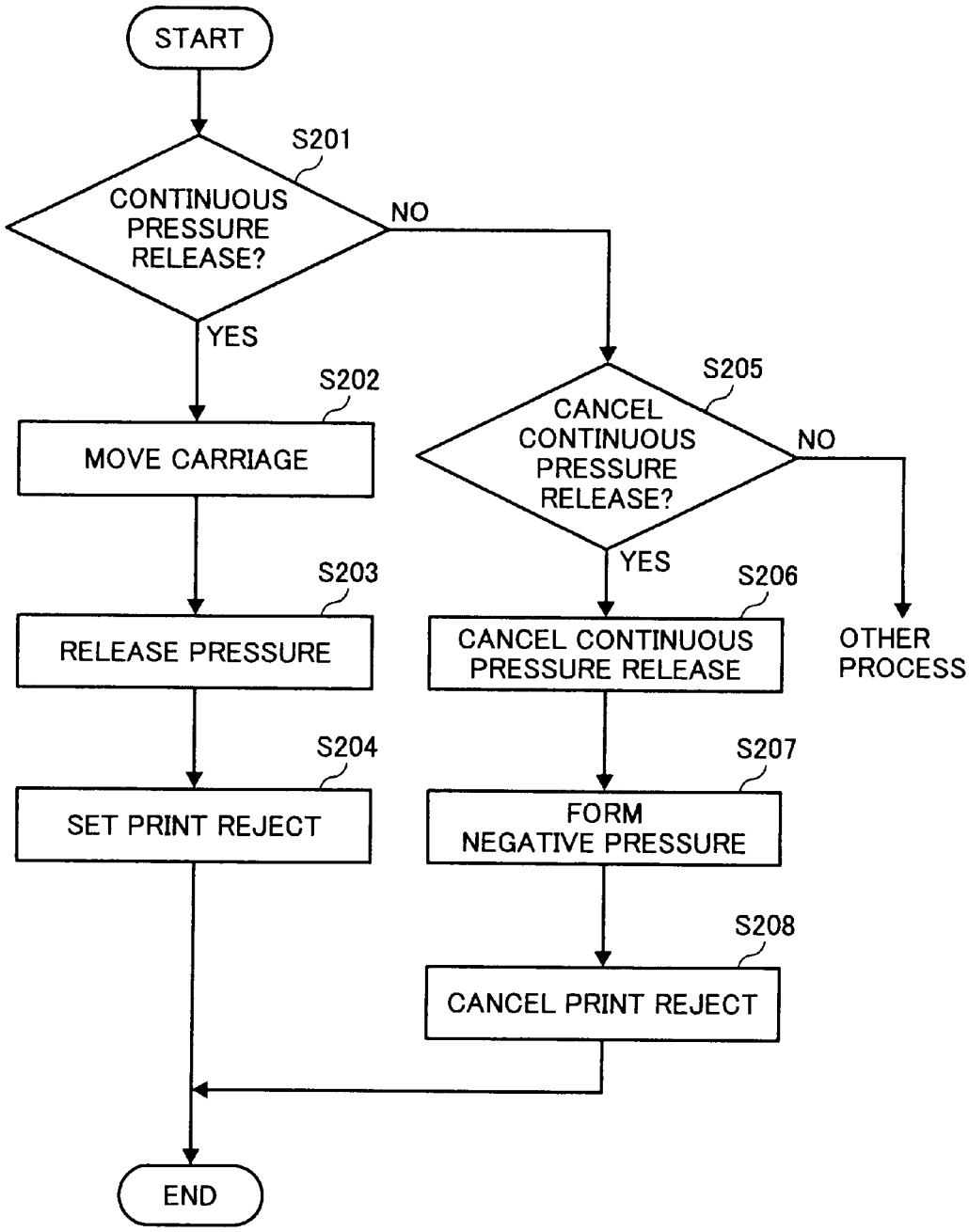
FIG. 17 is a flowchart illustrating an operation of a pressure release mechanism according to yet another exemplary embodiment.

Referring to FIG. 17, the following describes another example of operation of the pressure release mechanism 402 (depicted in FIG. 13) according to yet another exemplary embodiment FIG. 17 is a flowchart of the example of operation of the pressure release mechanism 402. According to this non-limiting exemplary embodiment, a user operates the control panel 319 (depicted in FIG. 7) to activate the pressure release mechanism 402. The pressure release mechanism 402A (depicted in FIG. 15) may be used instead of the pressure release mechanism 402.

In step S201, the controller 300 (depicted in FIG. 7) determines whether or not a user specifies a continuous pressure release by using the control panel 319. If the user specifies the continuous pressure release (i.e., if YES is selected in step S201), the carriage 23 (depicted in FIG. 2) moves to a capping position at which the caps 122A, 122B, 122C, and 122D (depicted in FIG. 2) cap the recording heads 24K, 24C, 24M, and 24Y (depicted in FIG. 2), respectively, in step S202. In step S203, the pressure release mechanism 402 is activated (e.g., a driver drives the pressure release mechanism 402) to cause the air release mechanisms 232K, 232C, 232M, and 232Y (depicted in FIG. 13) to release air. Namely, the pressure release mechanism 402 continuously releases pressure. In step S204, the controller 300 sets a print reject mode in which no print job (e.g., image forming job) is accepted.

If the user cancels the continuous pressure release by using the control panel 319 (i.e., if NO is selected in step S201), the controller 300 determines whether or not the pressure release mechanism 402 is deactivated (e.g., whether or not the continuous pressure release is canceled) in step S205. If the pressure release mechanism 402 is deactivated (i.e., if YES is selected in step S205), the air release mechanisms 232K, 232C, 232M, and 232Y do not continuously release air in step S206. In step S207, a negative pressure forming operation is performed for the recording heads 24K, 24C, 24M, and 24Y. In step S208, the controller 300 cancels the print reject mode so that an image forming operation is performed.

As described above, a user inputs a command for activating the pressure release mechanism 402 by using the control panel 319. Namely, the user may optionally select a mode for preventing an ink drop from dripping from the recording heads 24K, 24C, 24M, and 24Y. Thus, the image forming apparatus 1 (depicted in FIG. 1) may prevent dripping of an ink drop caused by change in outer air pressure.

Figure 18:
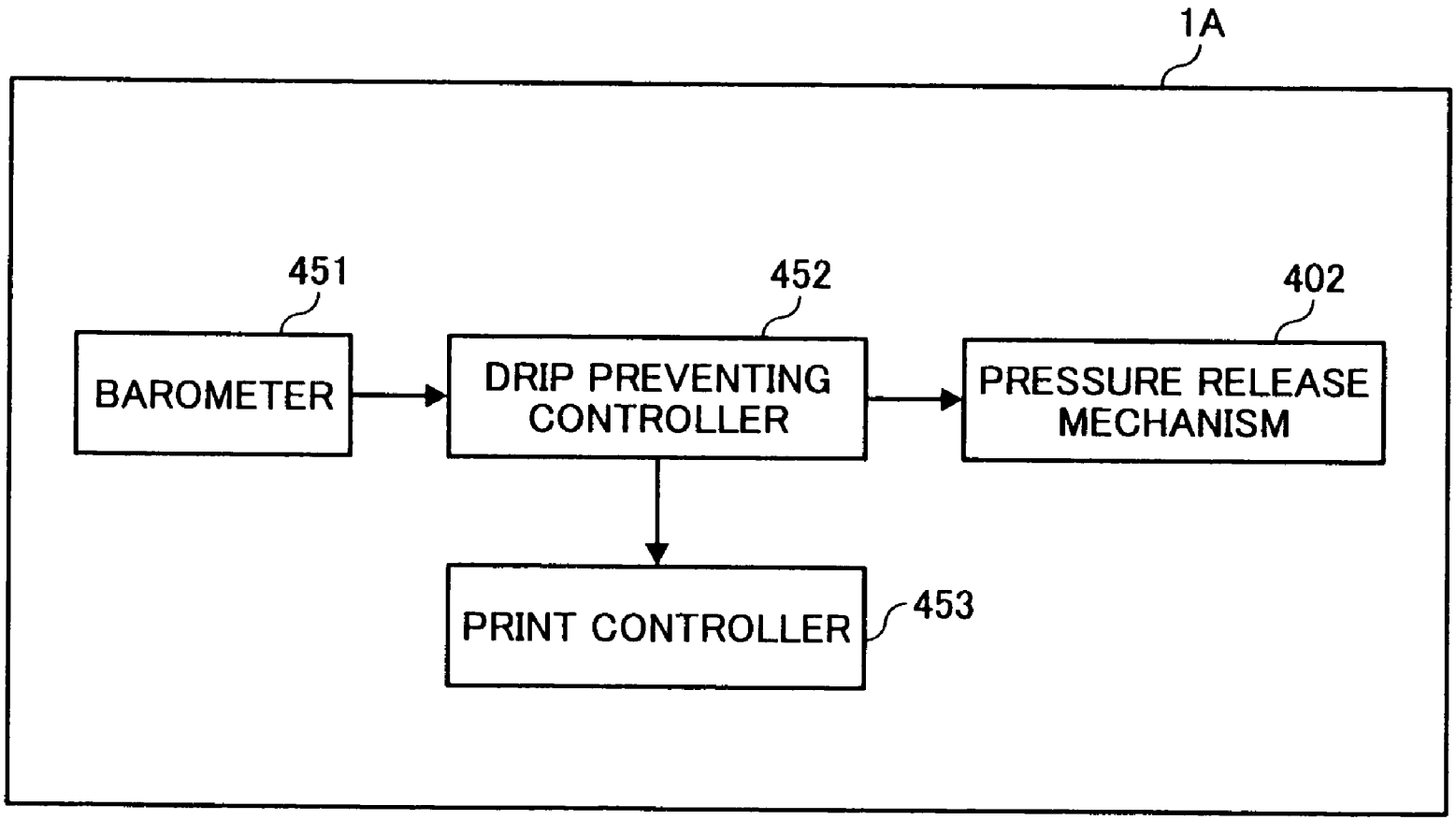
FIG. 18 is a block diagram of an image forming apparatus according to another exemplary embodiment.
Figure 19:
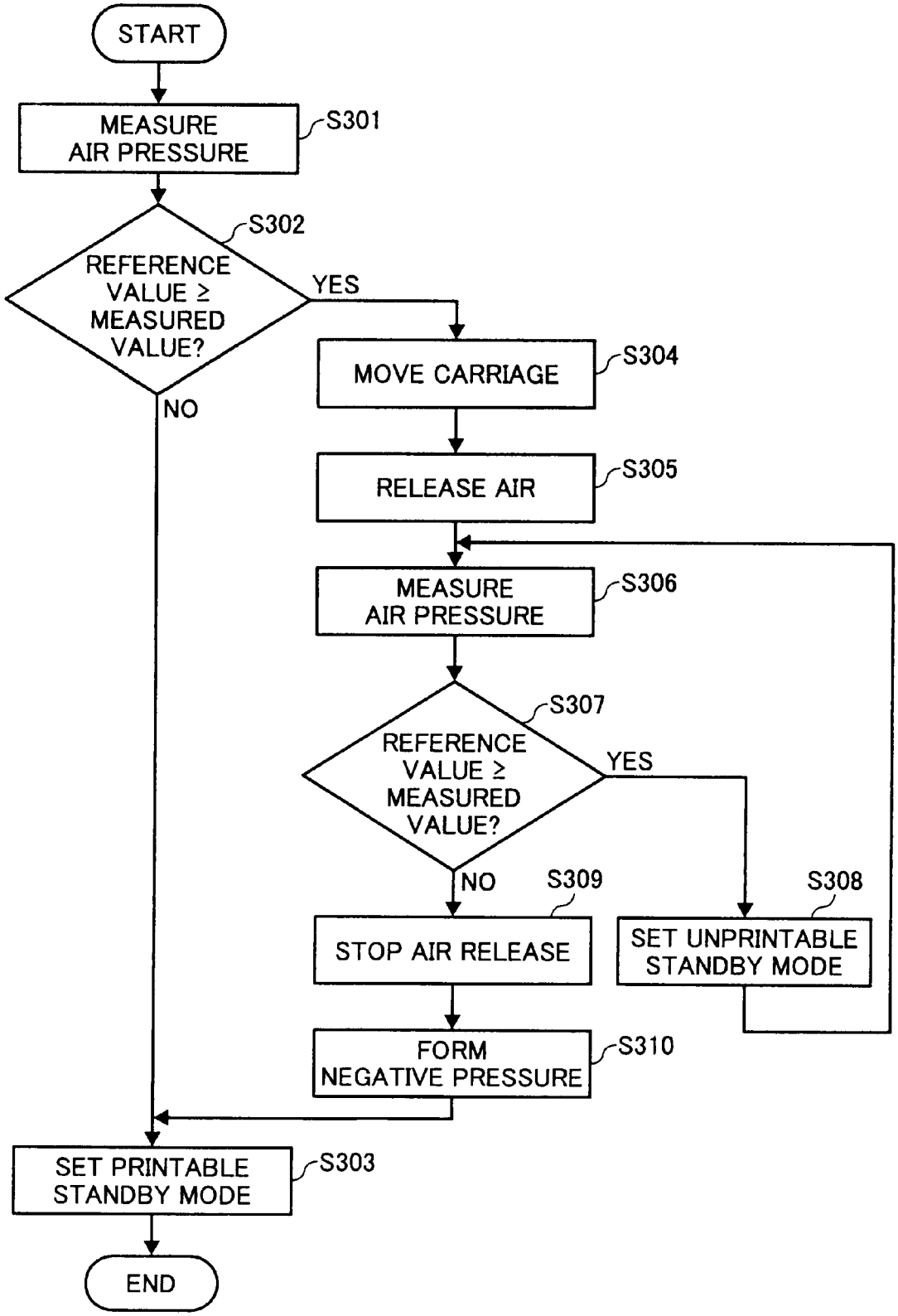
FIG. 19 is a flowchart illustrating an operation of the image forming apparatus shown in FIG. 18.

Referring to FIGS. 18 and 19, the following describes yet another example of operation of the pressure release mechanism 402 (depicted in FIG. 13) according to yet another exemplary embodiment. FIG. 18 is a block diagram of an image forming apparatus 1A according to yet another exemplary embodiment. FIG. 19 is a flowchart of the example of operation of the pressure release mechanism 402. The pressure release mechanism 402A (depicted in FIG. 15) may be used instead of the pressure release mechanism 402.

As illustrated in FIG. 18, the image forming apparatus 1A includes a barometer 451, a drip preventing controller 452, and a print controller 453. The other elements of the image forming apparatus 1A are common to the image forming apparatus 1 depicted in FIG. 1. The barometer 451 serves as an outer air pressure detector for measuring (e.g., detecting) an outer air pressure. The drip preventing controller 452 serves as a pressure release member activator for activating the pressure release member. For example, the drip preventing controller 452 controls an operation of the pressure release mechanism 402 based on a measurement result (e.g., a detection result) provided by the barometer 451, and sends a command for entering a standby mode to the print controller 453. The main controller 301 (depicted in FIG. 7) includes the drip preventing controller 452 and the print controller 453. The barometer 451 may be disposed near the recording head 24K, 24C, 24M, or 24Y.

As illustrated in FIG. 19, in step S301, the barometer 451 (depicted in FIG. 18) measures an outer air pressure. In step S302, the drip preventing controller 452 (depicted in FIG. 18) determines whether or not a measured pressure (e.g., a measured value) is equal to or smaller than a reference pressure (e.g., a reference value). If the measured value is not equal to or is not smaller than the reference value (i.e., if NO is selected in step S302), the drip preventing controller 452 sets a standby mode in which printing is available to the print controller 453 (depicted in FIG. 18) in step S303.

If the measured value is equal to or smaller than the reference value (i.e., if YES is selected in step S302), the carriage 23 (depicted in FIG. 2) moves to a position corresponding to the air release lever 422 (depicted in FIG. 13) in step S304. In step S305, the air release lever 422 presses the pressing members 237 (depicted in FIG. 13) so that the air release mechanisms 232K, 232C, 232M, and 232Y (depicted in FIG. 13) release air from the head tanks 25K, 25C, 25M, and 25Y (depicted in FIG. 8), respectively. Namely, the pressure release mechanism 402 (depicted in FIG. 18) is in a continuous pressure release mode.

In step S306, the barometer 451 measures an outer air pressure again. In step S307, the drip preventing controller 452 determines whether or not a measured pressure (e.g., a measured value) is equal to or smaller than a reference pressure (e.g., a reference value). If the measured value is still equal to or smaller than the reference value (i.e., if YES is selected in step S307), the drip preventing controller 452 sets a standby mode in which printing is not available to the print controller 453 in step S308.

If the measured value is not equal to or is not smaller than the reference value (i.e., if NO is selected in step S307), the pressure release lever 422 moves back to the initial position in step S309. Accordingly, the air release mechanisms 232K, 232C, 232M, and 232Y are closed to cancel the continuous pressure release mode so as to stop air release. In step S310, a negative pressure forming operation is performed for the recording heads 24K, 24C, 24M, and 24Y (depicted in FIG. 2). The drip preventing controller 452 sets the standby mode in which printing is available to the print controller 453 in step S303.

As described above, the image forming apparatus 1A (depicted in FIG. 18) includes the drip preventing controller 452 serving as a pressure release member activator for activating the pressure release mechanism 402 based on the measured outer air pressure. Thus, the image forming apparatus 1A may automatically enter a mode for preventing an ink drop from dripping from the recording heads 24K, 24C, 24M, and 24Y. Even when the image forming apparatus 1A is located in an aircraft or at a high elevation on land, the pressure release mechanism 402 can prevent dripping of an ink drop caused by change in outer air pressure.

The barometer 451 for measuring an outer air pressure is provided inside the image forming apparatus 1A and sends a measurement result (e.g., the measured outer air pressure) to the drip preventing controller 452. The barometer 451 may measure an outer air pressure near the recording heads 24K, 24C, 24M, and 24Y. Thus, the drip preventing controller 452 may perform a control operation with an increased precision.

Figure 20:
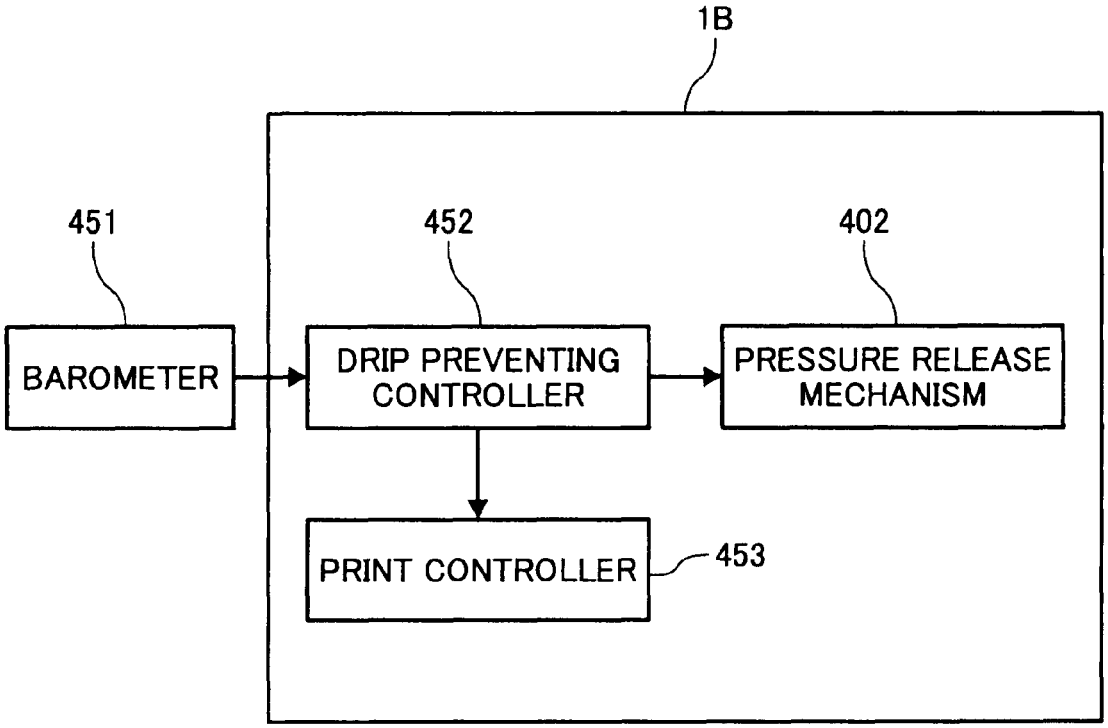
FIG. 20 is a block diagram of an image forming apparatus according to yet another exemplary embodiment.

Referring to FIG. 20, the following describes yet another example of operation of the pressure release mechanism 402 according to yet another exemplary embodiment FIG. 20 is a block diagram of an image forming apparatus 1B according to yet another exemplary embodiment. The pressure release mechanism 402A (depicted in FIG. 15) may be used instead of the pressure release mechanism 402.

As illustrated in FIG. 20, the image forming apparatus 1B does not include the barometer 451. The other elements of the image forming apparatus 1B are common to the image forming apparatus 1A depicted in FIG. 18. The barometer 451, serving as an outer air pressure detector for measuring an outer air pressure, is provided outside the image forming apparatus 1B. The barometer 451 sends a measurement result (e.g., a measured outer air pressure) to the drip preventing controller 452 provided inside the image forming apparatus 1B by wire or wireless. The drip preventing controller 452, the pressure release mechanism 402, and the print controller 453 perform operations common to the operations illustrated in FIG. 19.

The barometer 451 provided outside the image forming apparatus 1B measures an outer air pressure and sends a measurement result (e.g., the measured outer air pressure) to the image forming apparatus 1B. Even when the image forming apparatus 1B is located in an aircraft or otherwise at a high elevation on land, the barometer 451 may be connected to the image forming apparatus 1B as needed, resulting in decreased manufacturing costs of the image forming apparatus 1B.

Figure 21:
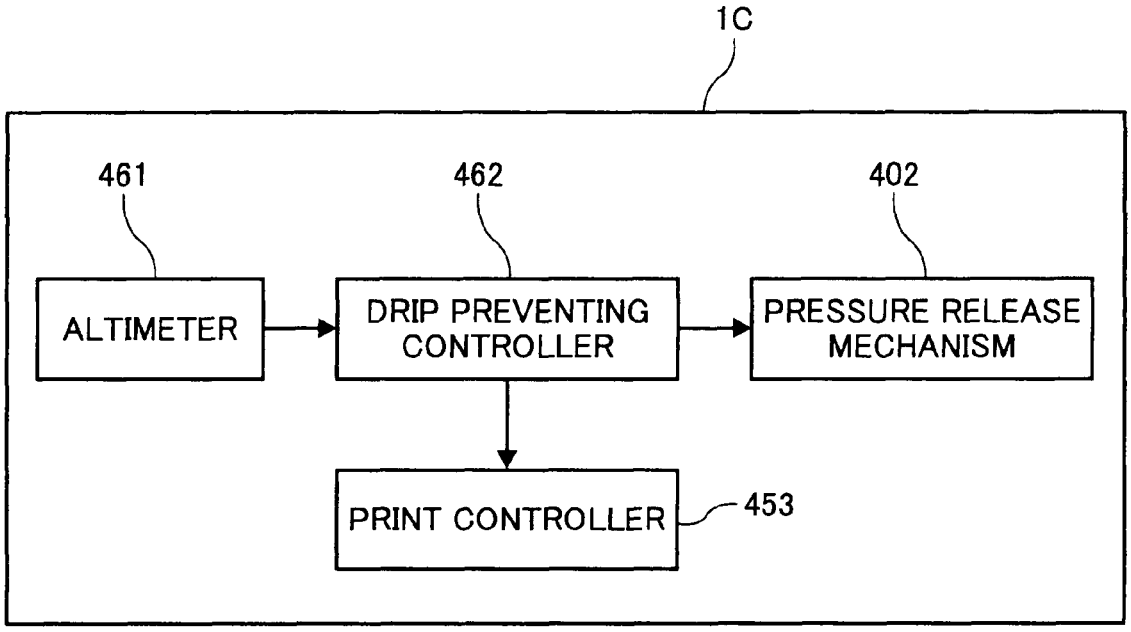
FIG. 21 is a block diagram of an image forming apparatus according to yet another exemplary embodiment.
Figure 22:
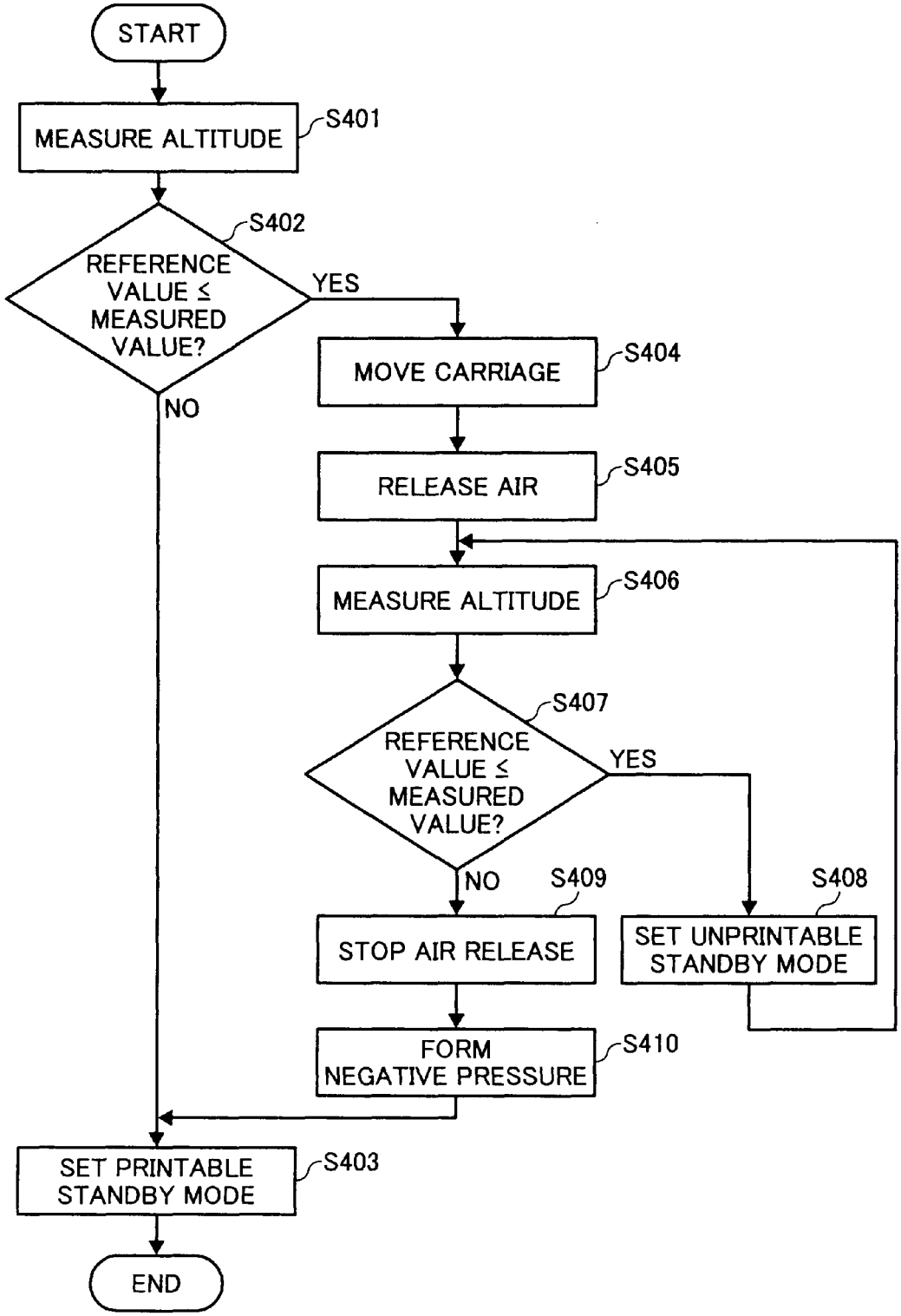
FIG. 22 is a flowchart illustrating an operation of the image forming apparatus shown in FIG. 21.

Referring to FIGS. 21 and 22, the following describes yet another example of operation of the pressure release mechanism 402 according to yet another exemplary embodiment. FIG. 21 is a block diagram of an image forming apparatus 1C according to yet another exemplary embodiment. FIG. 22 is a flowchart of the example of operation of the pressure release mechanism 402. The pressure release mechanism 402A (depicted in FIG. 15) may be used instead of the pressure release mechanism 402.

As illustrated in FIG. 21, the image forming apparatus 1C includes an altimeter 461 and a drip preventing controller 462 instead of the barometer 451 and the drip preventing controller 452 (depicted in FIG. 18), respectively. The other elements of the image forming apparatus 1C are common to the image forming apparatus 1A depicted in FIG. 18. The altimeter 461 serves as an altitude detector for measuring (e.g., detecting) an altitude at which the image forming apparatus 1C is located. The drip preventing controller 462 serves as a pressure release member activator for activating the pressure release member. For example, the drip preventing controller 462 controls an operation of the pressure release mechanism 402 based on a measurement result (e.g., a detection result) provided by the altimeter 461 and sends a command for entering a standby mode to the print controller 453. The main controller 301 (depicted in FIG. 7) includes the drip preventing controller 462 and the print controller 453.

As illustrated in FIG. 22, in step S401, the altimeter 461 (depicted in FIG. 21) measures an altitude. In step S402, the drip preventing controller 462 (depicted in FIG. 21) determines whether or not a measured altitude (e.g., a measured value) is equal to or greater than a reference pressure (e.g., a reference value). If the measured value is not equal to or is not greater than the reference value (i.e., if NO is selected in step S402), the drip preventing controller 462 sets a standby mode in which printing is available to the print controller 453 (depicted in FIG. 21) in step S403, because dripping of an ink drop due to a decreased outer air pressure may not occur when the altitude is lower than the reference value.

If the measured value is equal to or greater than the reference value (i.e., if YES is selected in step S402), the carriage 23 (depicted in FIG. 2) moves to a position corresponding to the air release lever 422 (depicted in FIG. 13) in step S404, because an outer air pressure decreases when the altitude is not smaller than the reference value. In step S405, the air release lever 422 presses the pressing members 237 (depicted in FIG. 13) so that the air release mechanisms 232K, 232C, 232M, and 232Y (depicted in FIG. 13) release air from the head tanks 25K, 25C, 25M, and 25Y (depicted in FIG. 8), respectively. Namely, the pressure release mechanism 402 (depicted in FIG. 21) is in a continuous pressure release mode.

In step S406, the altimeter 461 measures an altitude again. In step S407, the drip preventing controller 462 determines whether or not a measured altitude (e.g., a measured value) is equal to or greater than a reference pressure (e.g., a reference value). If the measured value (i.e., the altitude) is still equal to or greater than the reference value (i.e., if YES is selected in step S407), the drip preventing controller 462 sets a standby mode in which printing is not available to the print controller 453 in step S408.

If the measured value (i.e., the altitude) is not equal to or is not greater than the reference value (i.e., if NO is selected in step S407), an outer air pressure increases. Thus, the pressure release lever 422 moves back to the initial position in step S409. Accordingly, the air release mechanisms 232K, 232C, 232M, and 232Y are closed to cancel the continuous pressure release mode so as to stop air release. In step S410, a negative pressure forming operation is performed for the recording heads 24K, 24C, 24M, and 24Y (depicted in FIG. 2). The drip preventing controller 462 sets the standby mode in which printing is available to the print controller 453 in step S403.

As described above, the image forming apparatus 1C (depicted in FIG. 21) includes the drip preventing controller 462 serving as a pressure release member activator for activating the pressure release mechanism 402 based on the measured altitude. Thus, the image forming apparatus 1C may automatically enter a mode for preventing an ink drop from dripping from the recording heads 24K, 24C, 24M, and 24Y. Even when the image forming apparatus 1C is located in an aircraft or at an elevation on land, the pressure release mechanism 402 may prevent dripping of an ink drop caused by change in altitude relating to change in outer air pressure.

The altimeter 461 for measuring an altitude is provided inside the image forming apparatus 1C and sends a measurement result (e.g., a measured altitude) to the drip preventing controller 462. Thus, the drip preventing controller 462 may perform a control operation with an increased precision.

Figure 23:
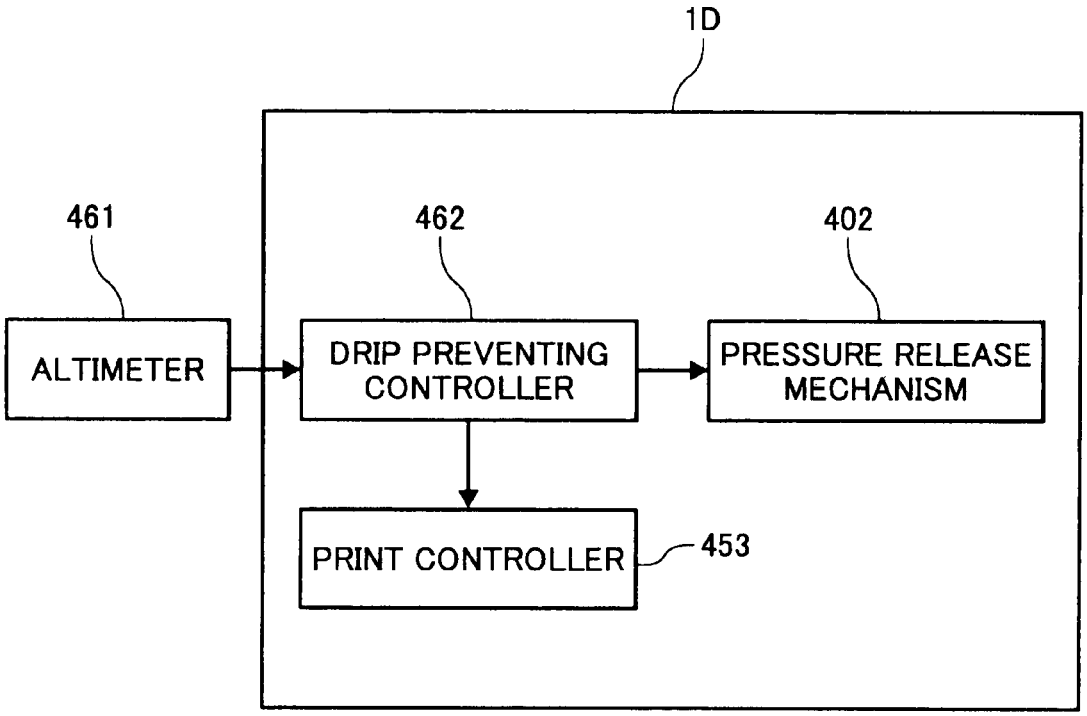
FIG. 23 is a block diagram of an image forming apparatus according to yet another exemplary embodiment.

Referring to FIG. 23, the following describes yet another example of operation of the pressure release mechanism 402 according to yet another exemplary embodiment. FIG. 23 is a block diagram of an image forming apparatus 1D according to yet another exemplary embodiment. The pressure release mechanism 402A (depicted in FIG. 15) may be used instead of the pressure release mechanism 402.

As illustrated in FIG. 23, the image forming apparatus 1D does not include the altimeter 461. The other elements of the image forming apparatus 1D are common to the image forming apparatus 1C depicted in FIG. 21. The altimeter 461, serving as an altitude detector for measuring (e.g., detecting) an altitude at which the image forming apparatus 1D is located, is provided outside the image forming apparatus 1D. The altimeter 461 sends a measurement result (e.g., a measured altitude) to the drip preventing controller 462 provided inside the image forming apparatus 1D by wire or wireless. The drip preventing controller 462, the pressure release mechanism 402, and the print controller 453 perform operations common to the operations illustrated in FIG. 22.

The altimeter 461 provided outside the image forming apparatus 1D measures an altitude and sends a measurement result (e.g., the measured altitude) to the image forming apparatus 1D. Even when the image forming apparatus 1D is located in an aircraft or at an elevation on land, the altimeter 461 may be connected to the image forming apparatus 1D as needed, resulting in decreased manufacturing costs of the image forming apparatus 1D.

Figure 24:
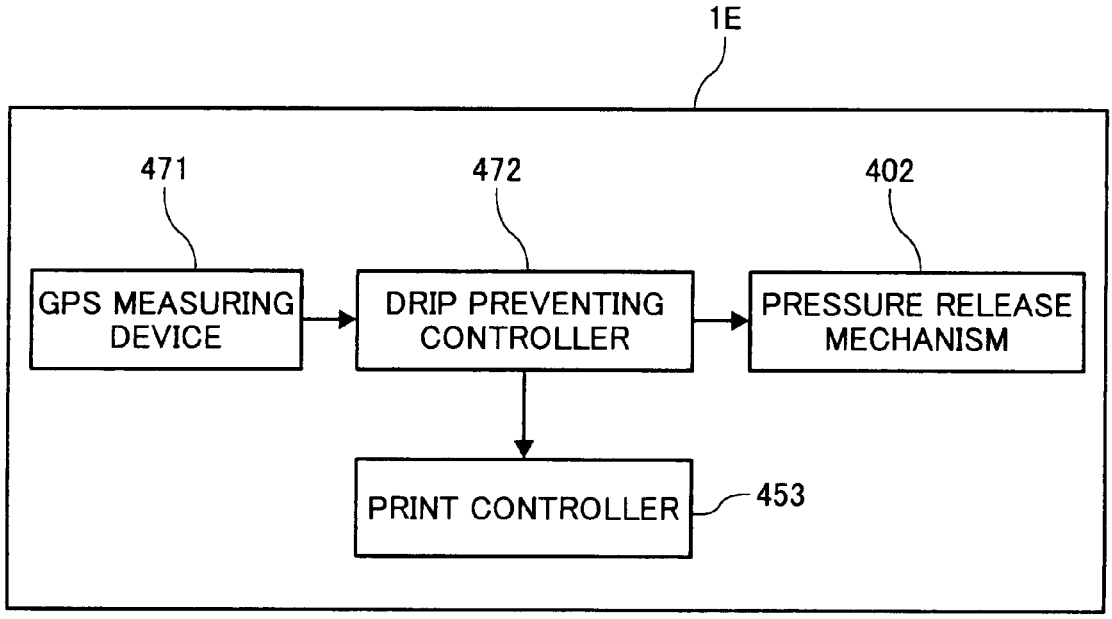
FIG. 24 is a block diagram of an image forming apparatus according to yet another exemplary embodiment.
Figure 25:
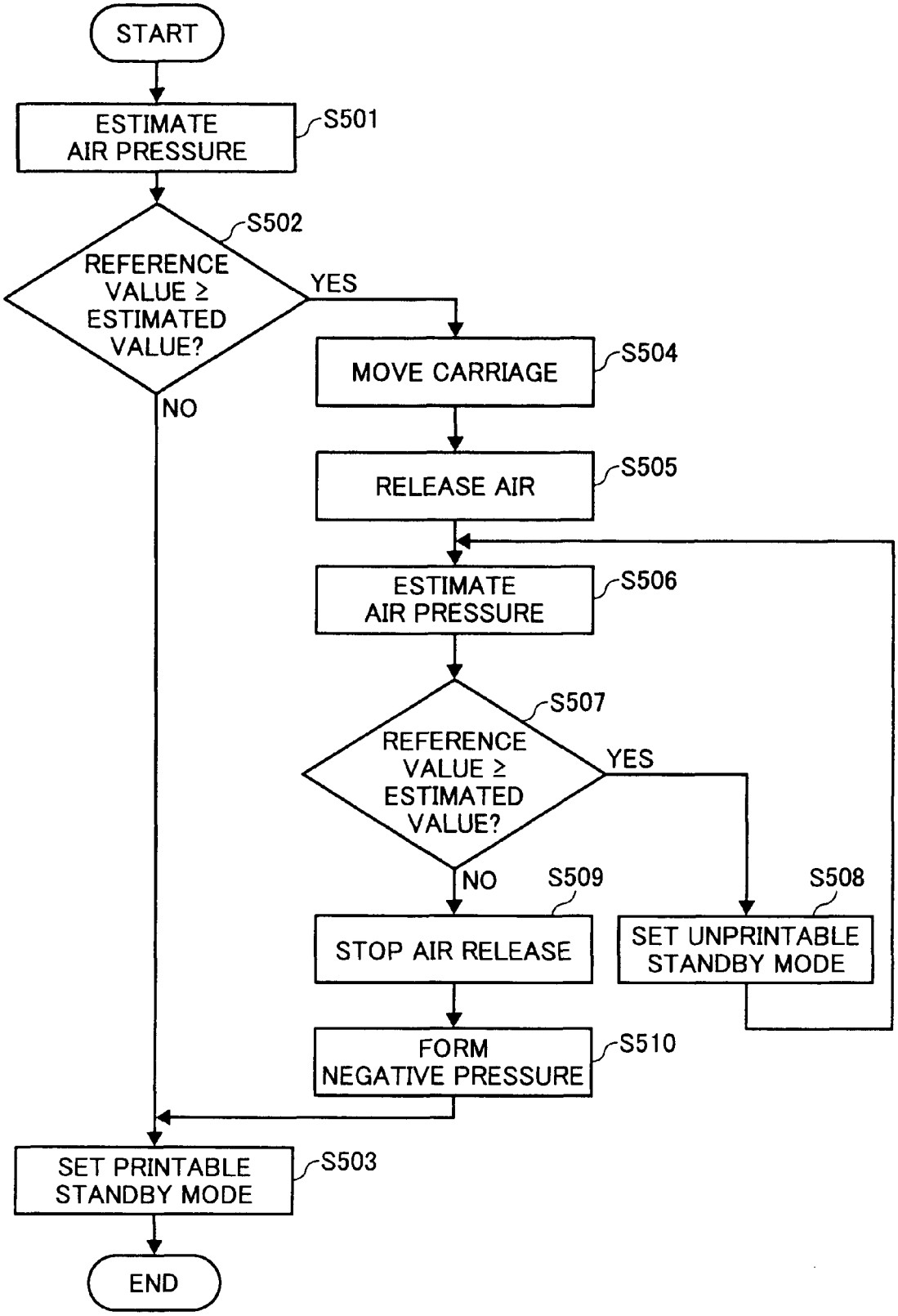
FIG. 25 is a flowchart illustrating an operation of the image forming apparatus shown in FIG. 24.

Referring to FIGS. 24 and 25, the following describes yet another example of operation of the pressure release mechanism 402 according to yet another exemplary embodiment FIG. 24 is a block diagram of an image forming apparatus 1E according to yet another exemplary embodiment FIG. 25 is a flowchart of the example of operation of the pressure release mechanism 402. The pressure release mechanism 402A (depicted in FIG. 15) may be used instead of the pressure release mechanism 402.

As illustrated in FIG. 24, the image forming apparatus 1E includes a GPS (global positioning system) measuring device 471 and a drip preventing controller 472 instead of the barometer 451 and the drip preventing controller 452 (depicted in FIG. 18), respectively. The other elements of the image forming apparatus 1E are common to the image forming apparatus 1A depicted in FIG. 18. The GPS measuring device 471 serves as a position detector for measuring (e.g., detecting) a position at which the image forming apparatus 1E is located. The GPS measuring device 471 is provided inside the image forming apparatus 1E. The drip preventing controller 472 serves as a pressure release member activator for activating the pressure release member. For example, the drip preventing controller 472 controls an operation of the pressure release mechanism 402 based on a measurement result (e.g., a detection result) provided by the GPS measuring device 471 and sends a command for entering a standby mode to the print controller 453. The main controller 301 (depicted in FIG. 7) includes the drip preventing controller 472 and the print controller 453.

The GPS measuring device 471 measures a position of the image forming apparatus 1E and sends a measurement result (e.g., the measured position) to the drip preventing controller 472. The drip preventing controller 472 estimates an altitude of the position of the image forming apparatus 1E based on topographic map information and the measured position of the image forming apparatus 1E stored in an internal memory (not shown). The drip preventing controller 472 estimates an outer air pressure based on the estimated altitude of the position of the image forming apparatus 1E. The drip preventing controller 472 controls an operation of the pressure release mechanism 402 based on the estimated outer air pressure. The topographic map information may not be stored in the internal memory, but may be obtained by communicating with an external device (not shown) as needed.

As illustrated in FIG. 25, in step S501, the GPS measuring device 471 (depicted in FIG. 24) measures a position of the image forming apparatus 1E, and estimates an altitude of the position of the image forming apparatus 1E based on the measured position and the topographic map information so as to estimate an outer air pressure. In step S502, the drip preventing controller 472 (depicted in FIG. 24) determines whether or not the estimated outer air pressure (e.g., an estimated value) is equal to or smaller than a reference pressure (e.g., a reference value). If the estimated value is not equal to or is not smaller than the reference value (i.e., if NO is selected in step S502), the drip preventing controller 472 sets a standby mode in which printing is available to the print controller 453 (depicted in FIG. 24) in step S503.

If the estimated value (e.g., the outer air pressure) is equal to or smaller than the reference value (i.e., if YES is selected in step S502), the carriage 23 (depicted in FIG. 2) moves to a position corresponding to the air release lever 422 (depicted in FIG. 13) in step S504. In step S505, the air release lever 422 presses the pressing members 237 (depicted in FIG. 13) so that the air release mechanisms 232K, 232C, 232M, and 232Y (depicted in FIG. 13) release air from the head tanks 25K, 25C, 25M, and 25Y (depicted in FIG. 8), respectively. Namely, the pressure release mechanism 402 (depicted in FIG. 24) is in a continuous pressure release mode.

In step S506, the GPS measuring device 471 measures a position of the image forming apparatus 1E again to estimate an outer air pressure. In step S507, the drip preventing controller 472 determines whether or not the estimated outer air pressure (e.g., an estimated value) is equal to or smaller than a reference pressure (e.g., a reference value). If the estimated value (i.e., the outer air pressure) is still equal to or smaller than the reference value (i.e., if YES is selected in step S507), the drip preventing controller 472 sets a standby mode in which printing is not available to the print controller 453 in step S508.

If the estimated value (i.e., the outer air pressure) is not equal to or is not smaller than the reference value (i.e., if NO is selected in step S507), for example, if the image forming apparatus 1E is moved to a location where an outer air pressure is greater than the reference pressure, the pressure release lever 422 moves back to the initial position in step S509. Accordingly, the air release mechanisms 232K, 232C, 232M, and 232Y are closed to cancel the continuous pressure release mode so as to stop air release. In step S510, a negative pressure forming operation is performed for the recording heads 24K, 24C, 24M, and 24Y (depicted in FIG. 2). The drip preventing controller 472 sets the standby mode in which printing is available to the print controller 453 in step S503.

As described above, the image forming apparatus 1E (depicted in FIG. 24) includes the drip preventing controller 472, serving as a pressure release member activator for activating the pressure release mechanism 402 based on the measured position of the image forming apparatus 1E. Thus, the image forming apparatus 1E may automatically enter a mode for preventing an ink drop from dripping from the recording heads 24K, 24C, 24M, and 24Y. Even when the image forming apparatus 1E is located on land at an elevation, the pressure release mechanism 402 can prevent dripping of an ink drop caused by change in altitude relating to change in outer air pressure.

Figure 26:
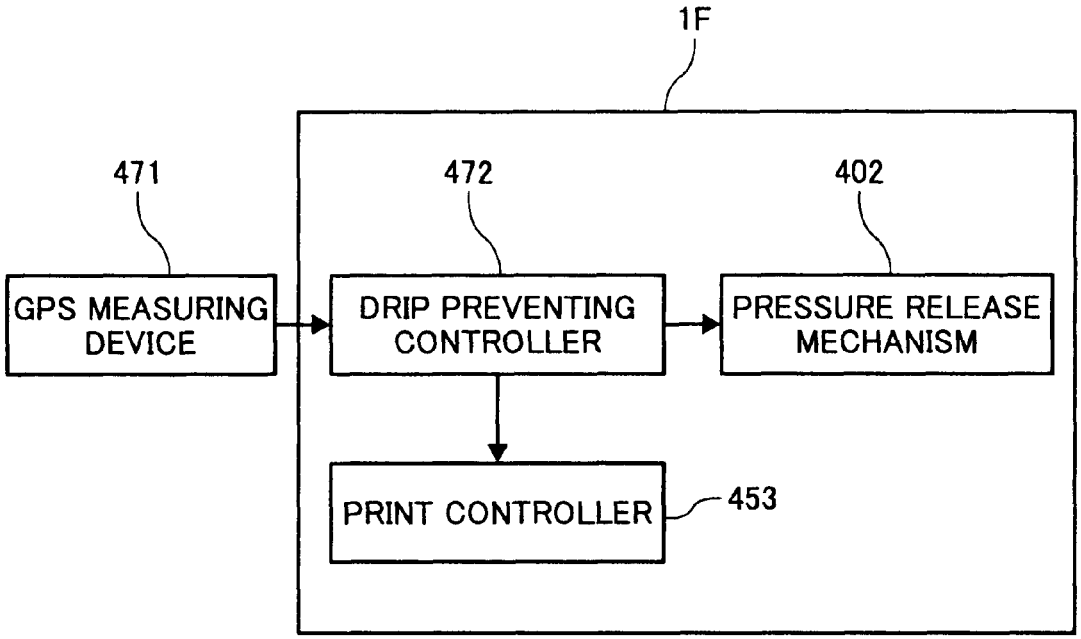
FIG. 26 is a block diagram of an image forming apparatus according to yet another exemplary embodiment.

Referring to FIG. 26, the following describes yet another example of operation of the pressure release mechanism 402 according to yet another exemplary embodiment. FIG. 26 is a block diagram of an image forming apparatus 1F according to yet another exemplary embodiment. The pressure release mechanism 402A (depicted in FIG. 15) may be used instead of the pressure release mechanism 402.

As illustrated in FIG. 26, the image forming apparatus 1F does not include the GPS measuring device 471. The other elements of the image forming apparatus 1F are common to the image forming apparatus 1E depicted in FIG. 24. The GPS measuring device 471, serving as a position detector for measuring (e.g., detecting) a position at which the image forming apparatus 1F is located, is provided outside the image forming apparatus 1F. The GPS measuring device 471 sends a measurement result (e.g., a measured position) to the drip preventing controller 472 provided inside the image forming apparatus 1F by wire or wireless. The drip preventing controller 472, the pressure release mechanism 402, and the print controller 453 perform operations common to the operations illustrated in FIG. 25.

The GPS measuring device 471 provided outside the image forming apparatus 1F measurement a position of the image forming apparatus 1F and sends a measurement result (e.g., the measured position) to the image forming apparatus 1F. Even when the image forming apparatus 1F is located on land at an elevation, the GPS measuring device 471 may be connected to the image forming apparatus 1F as needed, resulting in decreased manufacturing costs of the image forming apparatus 1F.

Figure 27:
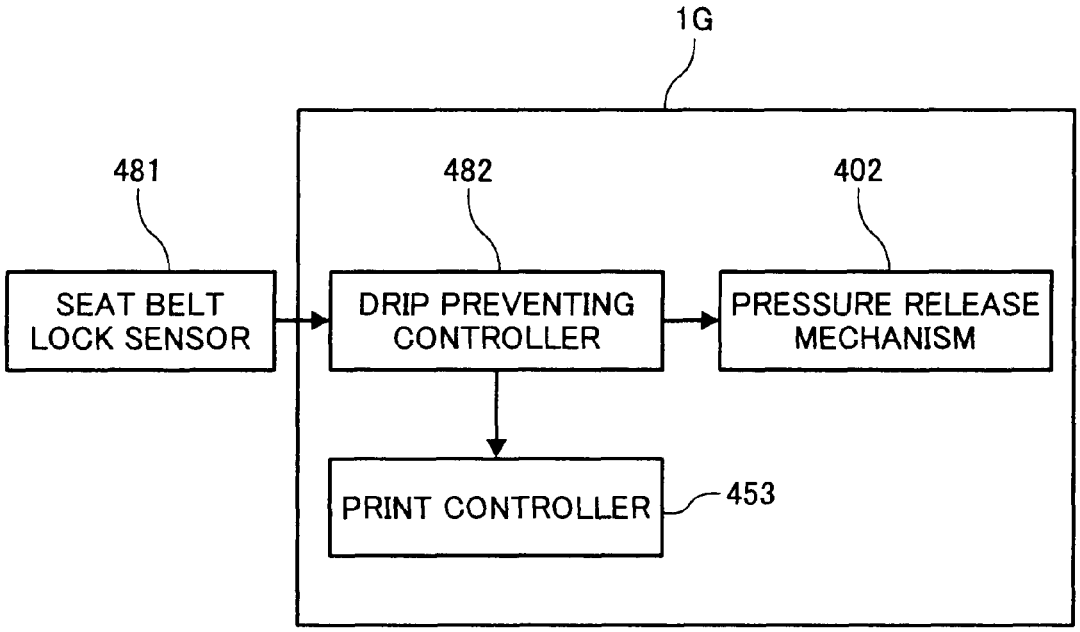
FIG. 27 is a block diagram of an image forming apparatus according to yet another exemplary embodiment.
Figure 28:
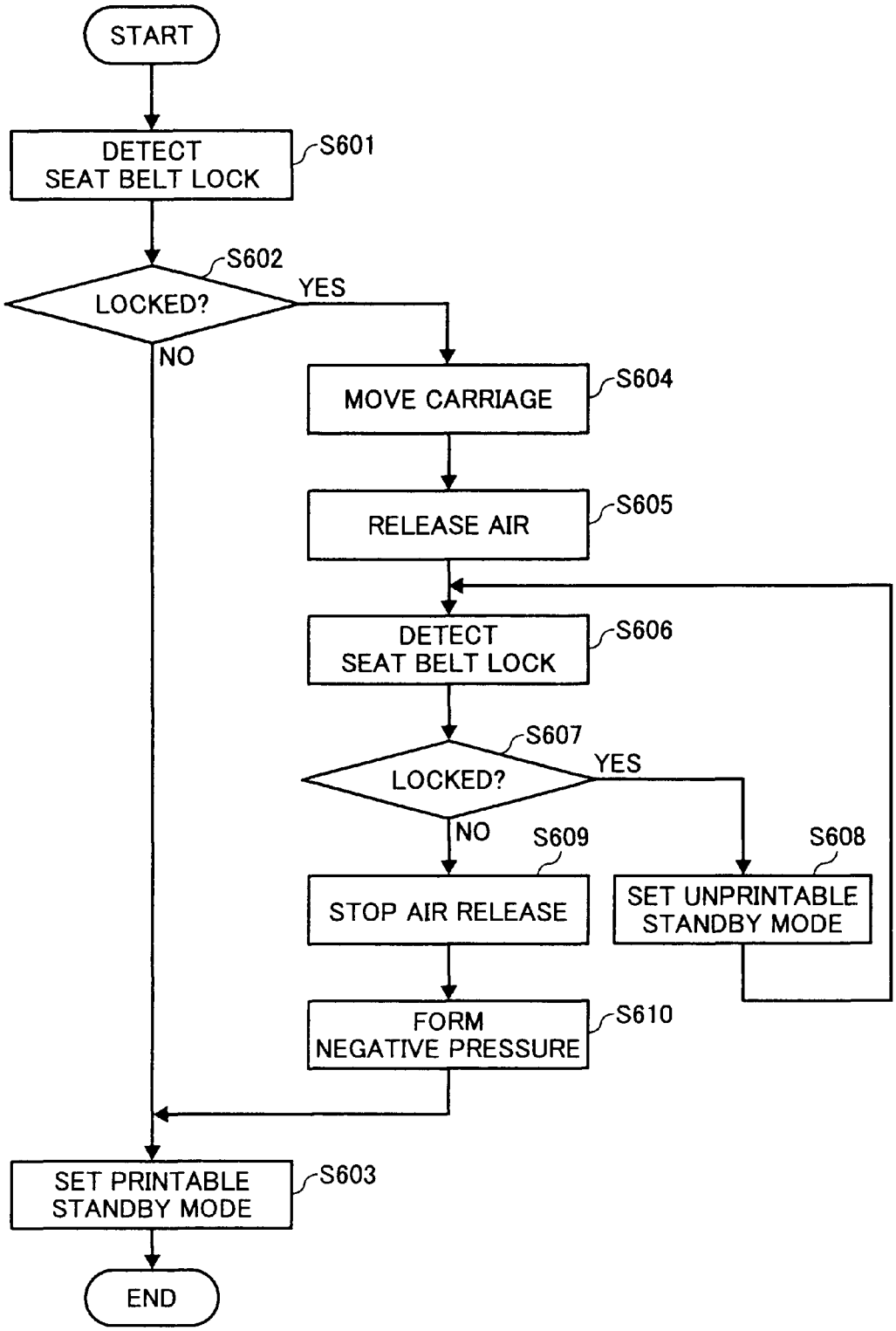
FIG. 28 is a flowchart illustrating an operation of the image forming apparatus shown in FIG. 27.

Referring to FIGS. 27 and 28, the following describes yet another example of operation of the pressure release mechanism 402 according to yet another exemplary embodiment. FIG. 27 is a block diagram of an image forming apparatus 1G according to yet another exemplary embodiment. FIG. 28 is a flowchart of the example of operation of the pressure release mechanism 402. The pressure release mechanism 402A (depicted in FIG. 15) may be used instead of the pressure release mechanism 402.

As illustrated in FIG. 27, the image forming apparatus 1G includes a drip preventing controller 482 instead of the drip preventing controller 452 (depicted in FIG. 18). The other elements of the image forming apparatus 1G are common to the image forming apparatus 1A depicted in FIG. 18. A seat belt lock sensor 481 for detecting a lock of a seat belt in an aircraft is connected to the image forming apparatus 1G. The drip preventing controller 482 serves as a pressure release member activator for activating the pressure release member. For example, the drip preventing controller 482 controls an operation of the pressure release mechanism 402 based on a detection result provided by the seat belt lock sensor 481 and sends a command for entering a standby mode to the print controller 453. The main controller 301 (depicted in FIG. 7) includes the drip preventing controller 482 and the print controller 453.

The seat belt lock sensor 481 detects whether or not an operator of the image forming apparatus 1G fastens a seat belt or whether or not an instruction for prompting the operator to lock the seat belt is sent. When the seat belt is locked or is to be locked, the seat belt lock sensor 481 sends a lock detection signal to the drip preventing controller 482 by wireless.

As illustrated in FIG. 28, in step S601, the seat belt lock sensor 481 (depicted in FIG. 27) detects a lock of a seat belt. In step S602, the drip preventing controller 482 (depicted in FIG. 27) determines whether or not the seat belt is locked based on a detection signal sent from the seat belt lock sensor 481. If the seat belt is not locked (i.e., if NO is selected in step S602), the drip preventing controller 482 sets a standby mode in which printing is available to the print controller 453 (depicted in FIG. 27) in step S603.

If the seat belt is locked (i.e., if YES is selected in step S602), the carriage 23 (depicted in FIG. 2) moves to a position corresponding to the air release lever 422 (depicted in FIG. 13) in step S604. In step S605, the air release lever 422 presses the pressing members 237 (depicted in FIG. 13) so that the air release mechanisms 232K, 232C, 232M, and 232Y (depicted in FIG. 13) release air from the head tanks 25K, 25C, 25M, and 25Y (depicted in FIG. 8), respectively. Namely, the pressure release mechanism 402 (depicted in FIG. 27) is in a continuous pressure release mode.

In step S606, the seat belt lock sensor 481 detects the lock of the seat belt again. In step S607, the drip preventing controller 482 determines whether or not the seat belt is locked based on a detection signal sent from the seat belt lock sensor 481. If the seat belt is still locked (i.e., if YES is selected in step S607), the drip preventing controller 482 sets a standby mode in which printing is not available to the print controller 453 in step S608.

If the seat belt is not locked (i.e., if NO is selected in step S607), the pressure release lever 422 moves back to the initial position in step S609. Accordingly, the air release mechanisms 232K, 232C, 232M, and 232Y are closed to cancel the continuous pressure release mode so as to stop air release. In step S610, a negative pressure forming operation is performed for the recording heads 24K, 24C, 24M, and 24Y (depicted in FIG. 2). The drip preventing controller 482 sets the standby mode in which printing is available to the print controller 453 in step S603.

As described above, the image forming apparatus 1G (depicted in FIG. 27) includes the drip preventing controller 482, serving as a pressure release member activator for activating the pressure release mechanism 402 based on the detection signal relating to the lock of the seat belt in the aircraft. Thus, the image forming apparatus 1G can automatically enter a mode for preventing an ink drop from dripping from the recording heads 24K, 24C, 24M, and 24Y. Even when the image forming apparatus 1G is located in an aircraft, the pressure release mechanism 402 can prevent dripping of an ink drop caused by change in outer air pressure.

Figure 29:
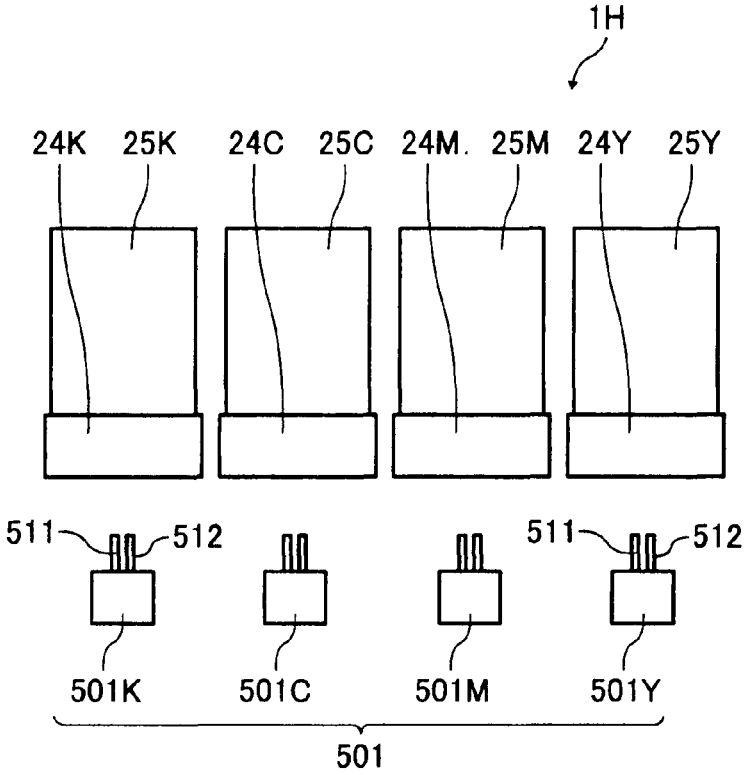
FIG. 29 is a sectional view of an image forming apparatus according to yet another exemplary embodiment.
Figure 30:
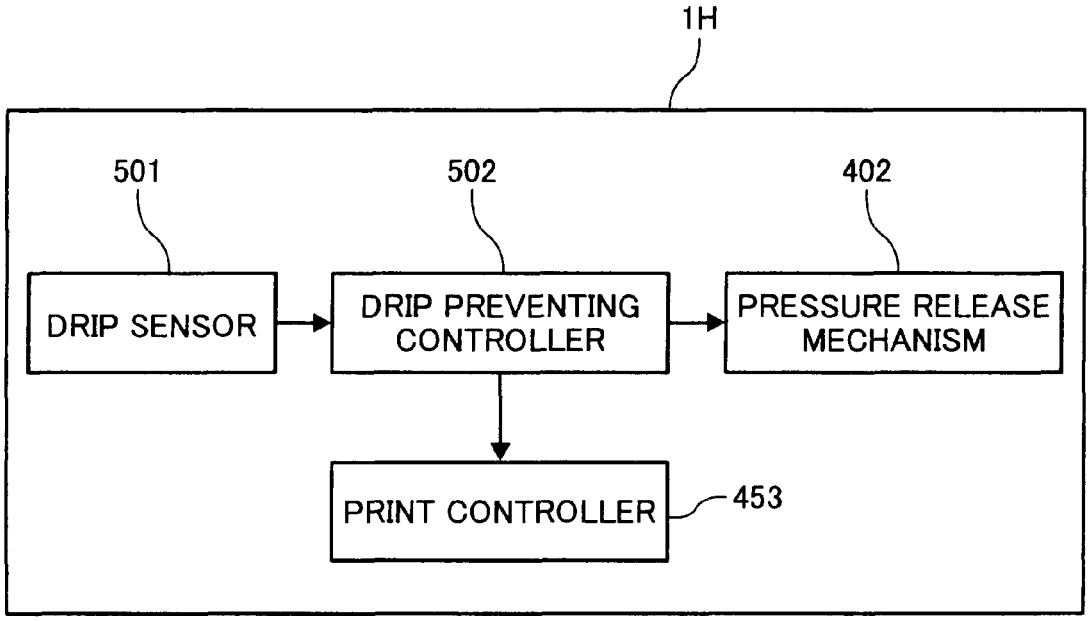
FIG. 30 is a block diagram of the image forming apparatus shown in FIG. 29.
Figure 31:
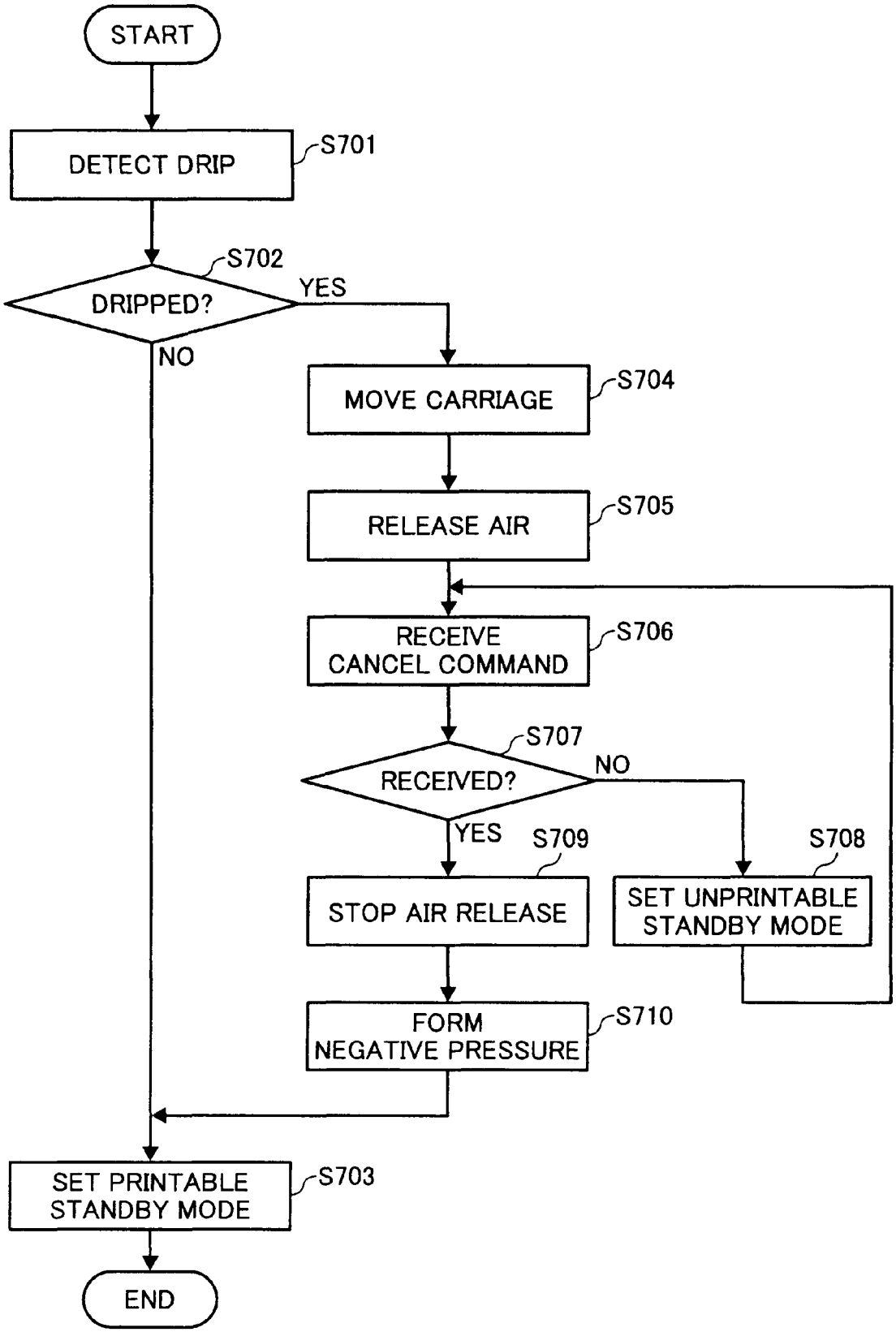
FIG. 31 is a flowchart illustrating an operation of the image forming apparatus shown in FIG. 30.

Referring to FIGS. 29 to 31, the following describes yet another example of operation of the pressure release mechanism 402 according to yet another exemplary embodiment. FIG. 29 is a schematic view of an image forming apparatus 1H according to yet another exemplary embodiment. FIG. 30 is a block diagram of the image forming apparatus 1H. FIG. 31 is a flowchart of the example of operation of the pressure release mechanism 402. The pressure release mechanism 402A (depicted in FIG. 15) may be used instead of the pressure release mechanism 402.

As illustrated in FIG. 29, the image forming apparatus 1H includes drip sensors 501 (e.g., drip sensors 501K, 501C, 501M, and 501Y). Each of the drip sensors 501K, 501C, 501M, and 501Y includes two detecting electrodes 511 and 512. The drip sensors 501K, 501C, 501M, and 501Y serve as a drip detector for detecting dripping of an ink drop from the recording heads 24K, 24C, 24M, and 24Y, respectively. The detecting electrodes 511 and 512 are arranged in a manner that a small space is provided between the detecting electrodes 511 and 512. When a liquid (e.g., an ink drop) is adhered to the detecting electrodes 511 and 512, an electric current flows between the detecting electrodes 511 and 512. Thus, the drip sensors 501K, 501C, 501M, and 501Y detect dripping of an ink drop.

As illustrated in FIG. 30, the image forming apparatus 1H further includes a drip preventing controller 502 instead of the drip preventing controller 452 (depicted in FIG. 18). The drip sensor 501 replaces the barometer 451 (depicted in FIG. 18). The other elements of the image forming apparatus 1H are common to the image forming apparatus 1A depicted in FIG. 18. The drip preventing controller 502 serves as a pressure release member activator for activating the pressure release member. For example, the drip preventing controller 502 controls an operation of the pressure release mechanism 402 based on a detection result provided by the drip sensor 501 and sends a command for entering a standby mode to the print controller 453. The main controller 301 (depicted in FIG. 7) includes the drip preventing controller 502 and the print controller 453.

As illustrated in FIG. 31, in step S701, the drip sensor 501 (depicted in FIG. 30) detects dripping of an ink drop from the recording head 24K, 24C, 24M, or 24Y (depicted in FIG. 29). In step S702, the drip preventing controller 502 (depicted in FIG. 30) determines whether or not an ink drop drips from the recording head 24K, 24C, 24M, or 24Y based on a detection result sent from the drip sensor 501. If the ink drop is not dripped (i.e., if NO is selected in step S702), the drip preventing controller 502 sets a standby mode in which printing is available to the print controller 453 (depicted in FIG. 30) in step S703.

If the ink drop is dripped (i.e., if YES is selected in step S702), the carriage 23 (depicted in FIG. 2) moves to a position corresponding to the air release lever 422 (depicted in FIG. 13) in step S704. In step S705, the air release lever 422 presses the pressing members 237 (depicted in FIG. 13) so that the air release mechanisms 232K, 232C, 232M, and 232Y (depicted in FIG. 13) release air from the head tanks 25K, 25C, 25M, and 25Y (depicted in FIG. 29), respectively. Namely, the pressure release mechanism 402 (depicted in FIG. 30) is in a continuous pressure release mode.

In step S706, the drip preventing controller 502 receives information relating to a command for canceling the continuous pressure release mode from the control panel 319 (depicted in FIG. 7), for example. In step S707, the drip preventing controller 502 determines whether or not the drip preventing controller 502 receives the command for canceling the continuous pressure release mode (e.g., a command for canceling a drip preventing mode). In the image forming apparatus 1H, once an ink drop is adhered to the detecting electrodes 511 and 512, the ink drop sticks to the detecting electrodes 511 and 512 unless a user, an operator, a service engineer, or the like of the image forming apparatus 1H removes the ink drop from the detecting electrodes 511 and 512. Therefore, the drip preventing controller 502 determines whether or not the drip preventing controller 502 receives the command for canceling the continuous pressure release mode from the control panel 319 or the like after the user, the operator, the service engineer, or the like removes the ink drop.

If the drip preventing controller 502 does not receive the command for canceling the continuous pressure release mode from the control panel 319 or the like (i.e., if NO is selected in step S707), the drip preventing controller 502 sets a standby mode in which printing is not available to the print controller 453 in step S708.

If the drip preventing controller 502 receives the command for canceling the continuous pressure release mode from the control panel 319 or the like (i.e., if YES is selected in step S707), the pressure release lever 422 moves back to the initial position in step S709. Accordingly, the air release mechanisms 232K, 232C, 232M, and 232Y are closed to cancel the continuous pressure release mode so as to stop air release. In step S710, a negative pressure forming operation is performed for the recording heads 24K, 24C, 24M, and 24Y. The drip preventing controller 502 sets the standby mode in which printing is available to the print controller 453 in step S703.

As described above, the image forming apparatus 1H (depicted in FIG. 30) includes the drip preventing controller 502 serving as a pressure release member activator for activating the pressure release mechanism 402 based on a detection result relating to whether or not an ink drop drips from the recording head 24K, 24C, 24M, or 24Y. Thus, the image forming apparatus 1H can quickly cope with dripping of an ink drop caused by change in outer air pressure, for example.

Figure 32:
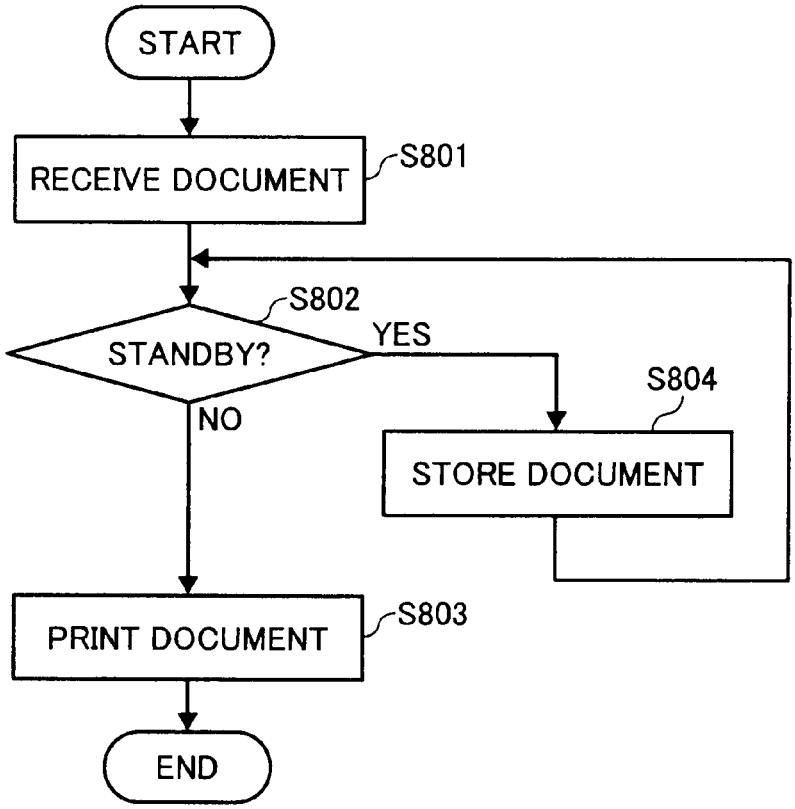
FIG. 32 is a flowchart illustrating an operation of an image forming apparatus according to yet another exemplary embodiment.

Referring to FIG. 32, the following describes yet another example of operation of the pressure release mechanism 402 according to yet another exemplary embodiment FIG. 32 is a flowchart of the example of operation of the pressure release mechanism 402 (depicted in FIG. 13). The pressure release mechanism 402A (depicted in FIG. 15) may be used instead of the pressure release mechanism 402.

As described above, when the pressure release mechanism 402 is in a continuous pressure release mode (i.e., when the air release mechanisms 232K, 232C, 232M, and 232Y depicted in FIG. 13 release air from the head tanks 25K, 25C, 25M, and 25Y depicted in FIG. 2, respectively), the image forming apparatus (i.e., the image forming apparatus 1, 1A, 1B, 1C, 1D, 1E, 1F, 1G, or 1H) is in a standby mode in which printing is not available. If the image forming apparatus has a facsimile function, the image forming apparatus may not print a document (e.g., print data) even when the image forming apparatus receives the document.

As illustrated in FIG. 32, in step S801, the image forming apparatus receives a document (e.g., print data). In step S802, the controller 300 (depicted in FIG. 7) determines whether or not the image forming apparatus is in the standby mode in which printing is not available. If the image forming apparatus is not in the standby mode in which printing is not available (i.e., if NO is selected in step S802), the image forming apparatus prints the received document in step S803. If the image forming apparatus is in the standby mode in which printing is not available (i.e., if YES is selected in step S802), the image forming apparatus stores the received document in a memory (not shown) in step S804. If the image forming apparatus is not in the standby mode in which printing is not available when the controller 300 determines whether or not the image forming apparatus is in the standby mode again in step S802, the image forming apparatus prints the received document stored in the memory in step S803.

As described above, even when the pressure release mechanism 402 is activated, the image forming apparatus temporarily prohibits printing when the image forming apparatus receives a print request (e.g., a document). Thus, the image forming apparatus may print the received document without losing it.

Figure 33:
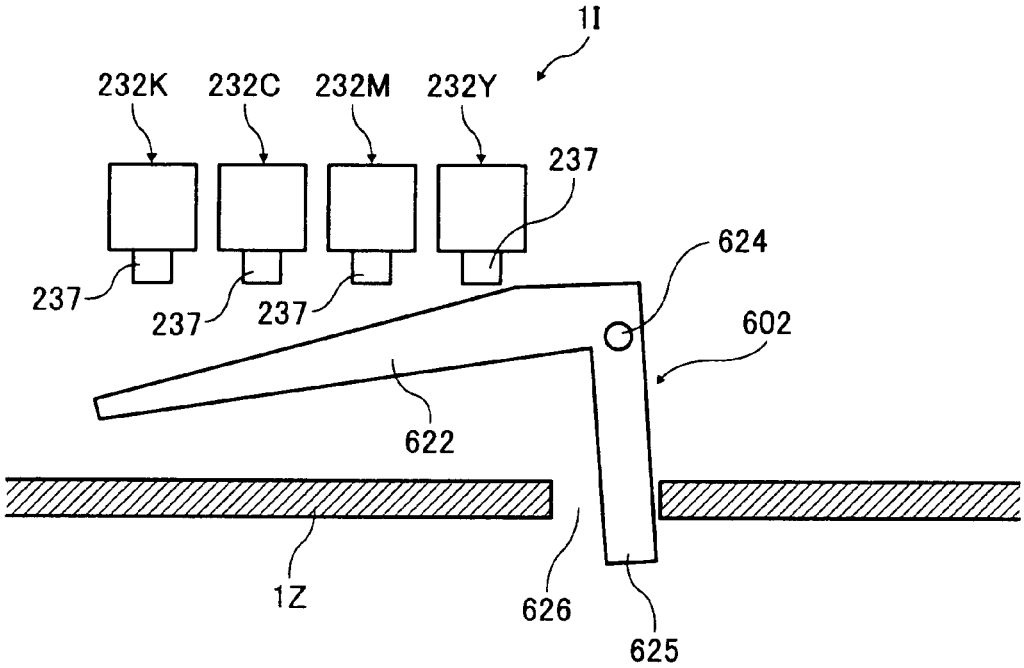
FIG. 33 is a plane view of an image forming apparatus according to yet another exemplary embodiment.
Figure 34:
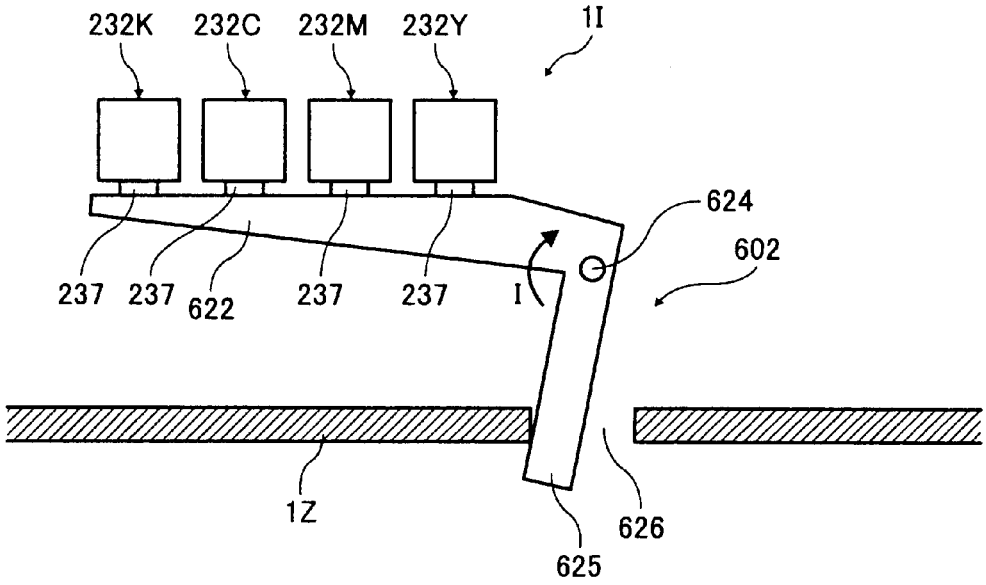
FIG. 34 is a plane view of the image forming apparatus shown in FIG. 33 during an air release operation.

Referring to FIGS. 33 and 34, the following describes an image forming apparatus 1I according to yet another exemplary embodiment FIGS. 33 and 34 illustrate a plane view of the image forming apparatus 1I.

As illustrated in FIG. 33, the image forming apparatus 1I includes a pressure release mechanism 602 and a body cover 1Z. The pressure release mechanism 602 includes an air release lever 622, a support shaft 624, and a control lever 625. The body cover 1Z includes a hole 626. The other elements of the image forming apparatus 1I are common to the image forming apparatus 1 (depicted in FIG. 1).

A user manually operates the pressure release mechanism 602 serving as a pressure release member. The air release lever 622 presses the pressing members 237 of the air release mechanisms 232K, 232C, 232M, and 232Y, respectively. The support shaft 624 rotatably supports the air release lever 622. The control lever 625 serves as a control member controlled from an outside of the image forming apparatus 1I. The control lever 625 is integrally provided with the air release lever 622. A part of the control lever 625 protrudes from the hole 626 formed in the body cover 1Z towards the outside of the image forming apparatus 1I. Alternatively, the control lever 625 may not protrude from the body cover 1Z. For example, when the body cover 1Z is openable and closable or when the body cover 1Z includes a cover which is openable and closable, the control lever 625 may be provided in a space in which the user may manually operate the control lever 625 when the body cover 1Z or the cover included in the body cover 1Z is opened.

When the image forming apparatus 1I is located in an aircraft or at an elevation otherwise, a decreased outer air pressure may cause dripping of an ink drop from the recording heads 24K, 24C, 24M, and 24Y (depicted in FIG. 2). However, when the user manually swings the control lever 625 in a rotating direction I as illustrated in FIG. 34, the air release lever 622 swings in the rotating direction I. Thus, the air release lever 622 presses the pressing members 237. Almost simultaneously, the air release mechanisms 232K, 232C, 232M, and 232Y release air from the head tanks 25K, 25C, 25M, and 25Y (depicted in FIG. 2), respectively.

Accordingly, inner air pressures in the head tanks 25K, 25C, 25M, and 25Y, respectively, become equivalent to an outer air pressure in an environment in which the image forming apparatus 1I is located.

As described above, the image forming apparatus 1I includes the pressure release mechanism 602 manually operated by the user. Thus, the user may easily switch the pressure release mechanism 602 into a drip preventing mode to prevent dripping of an ink drop caused by change in outer air pressure. Even when the image forming apparatus 1I is powered off, the pressure release mechanism 602 can prevent dripping of an ink drop. For example, even when the image forming apparatus 1I is carried by a transportation vehicle (e.g., an aircraft or the like) as a cargo without being operated, the user may swing the air release lever 622 to prevent dripping of an ink drop before the image forming apparatus 1I is loaded on the transportation vehicle.

Figure 35:
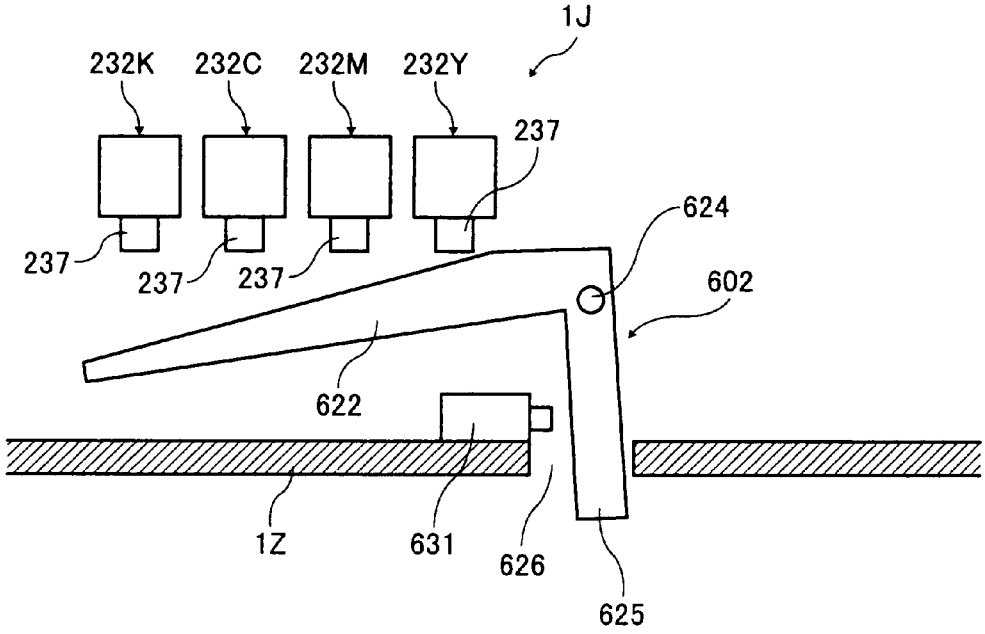
FIG. 35 is a plane view of an image forming apparatus according to yet another exemplary embodiment.
Figure 36:
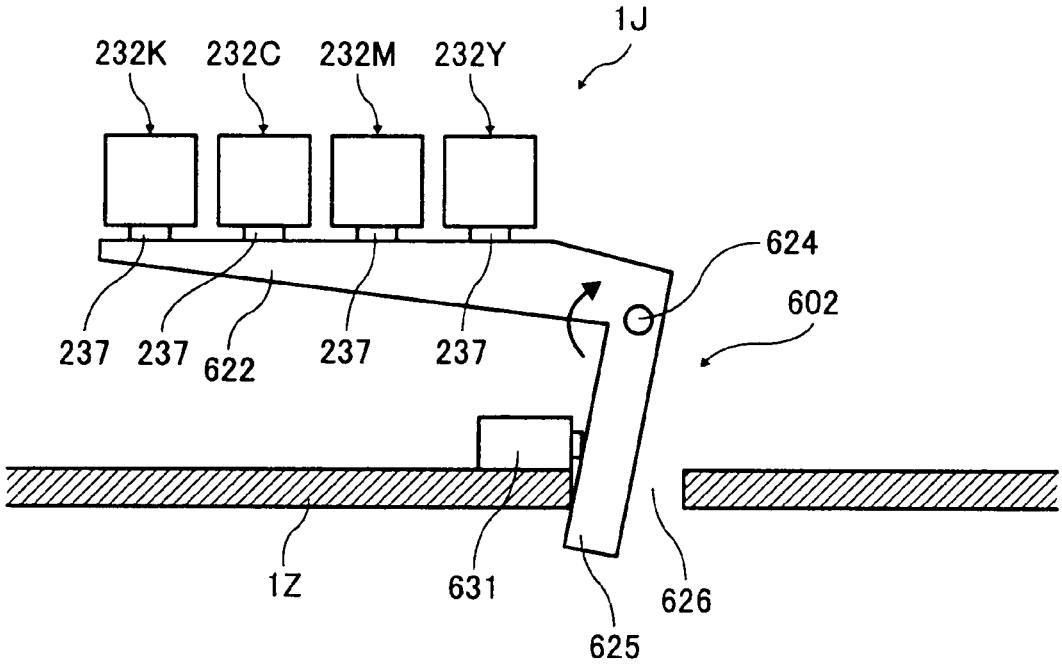
FIG. 36 is a plane view of the image forming apparatus shown in FIG. 35 during an air release operation.
Figure 37:
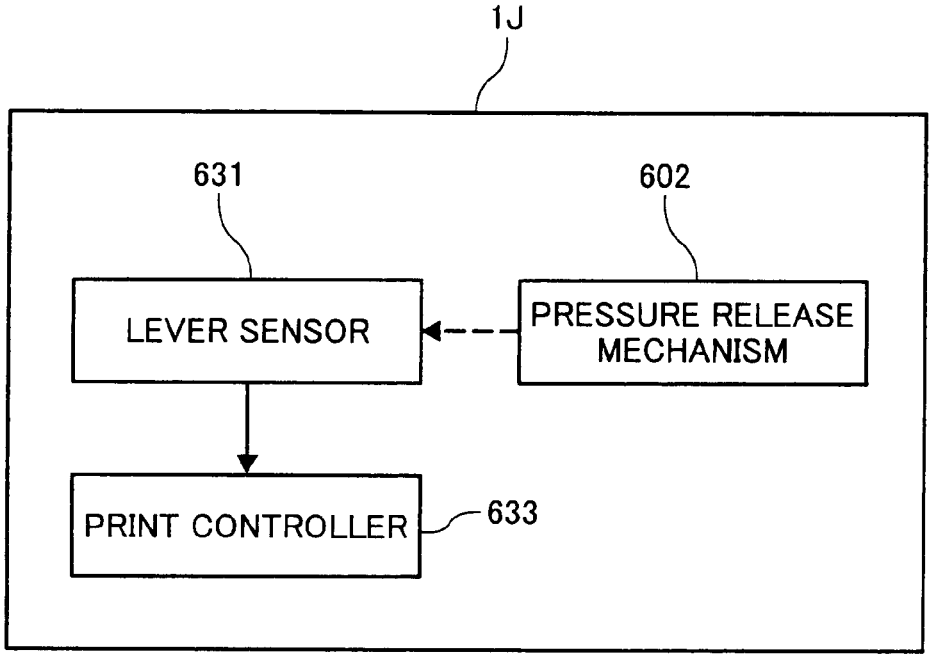
FIG. 37 is a block diagram of the image forming apparatus shown in FIG. 35.
Figure 38:
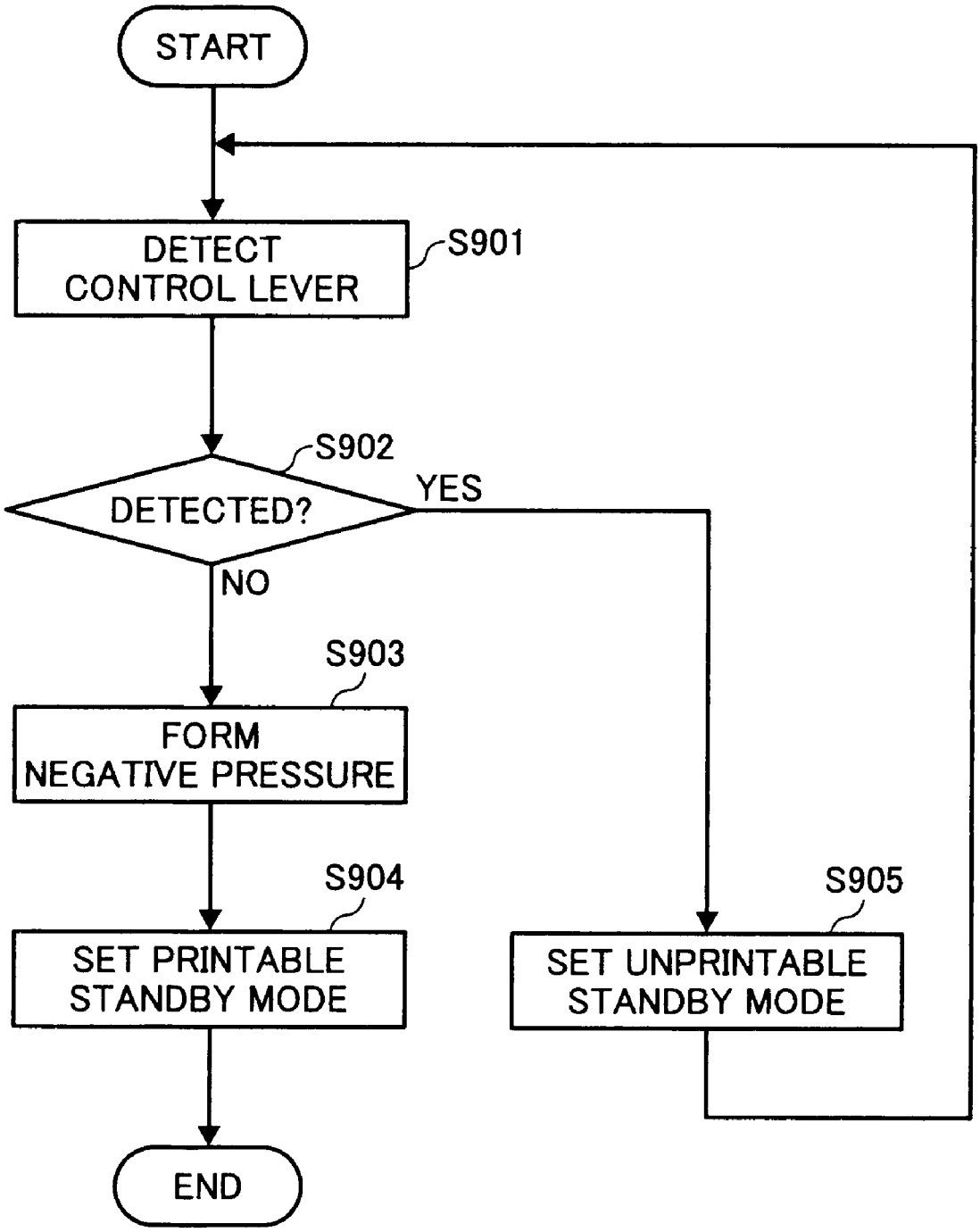
FIG. 38 is a flowchart illustrating an operation of the image forming apparatus shown in FIG. 37.

Referring to FIGS. 35 to 38, the following describes an image forming apparatus 1J according to yet another exemplary embodiment FIGS. 35 and 36 illustrate a plane view of the image forming apparatus 1J. FIG. 37 is a block diagram of the image forming apparatus 1J. FIG. 38 is a flowchart of an example of operation of the pressure release mechanism 602.

As illustrated in FIG. 35, the image forming apparatus 1J includes a lever sensor 631. The other elements of the image forming apparatus 1J are common to the image forming apparatus 1I (depicted in FIG. 33).

The lever sensor 631 serves as a lever position detector for detecting a position (e.g., a condition) of the control lever 625. When the control lever 625 is at a standby position at which the air release lever 622 does not press the pressing members 237 as illustrated in FIG. 35 (i.e., when the pressure release mechanism 602 is not in a continuous pressure release mode), the lever sensor 631 is turned off. When the control lever 625 is at an air release position at which the air release lever 622 presses the pressing members 237 as illustrated in FIG. 36 (i.e., when the pressure release mechanism 602 is in the continuous pressure release mode), the lever sensor 631 is turned on. According to this non-limiting exemplary embodiment, the lever sensor 631 includes a push switch. However, the lever sensor 631 may include a photo sensor.

As illustrated in FIG. 37, the image forming apparatus 1J further includes a print controller 633. The print controller 633 controls an image forming operation based on a detection result provided by the lever sensor 631. The main controller 301 (depicted in FIG. 7) includes the print controller 633.

As illustrated in FIG. 38, the lever sensor 631 (depicted in FIG. 35) detects a position of the controller lever 625 (depicted in FIG. 35) in step S901. In step S902, the controller 300 (depicted in FIG. 7) determines whether or not the control lever 625 is at the air release position based on a detection result provided by the lever sensor 631. If the control lever 625 is not at the air release position (i.e., if NO is selected in step S902), a negative pressure forming operation is performed for the recording heads 24K, 24C, 24M, and 24Y (depicted in FIG. 2) in step S903. In step S904, the controller 300 sets a standby mode in which printing is available to the print controller 633 (depicted in FIG. 37). If the control lever 625 is at the air release position (i.e., if YES is selected in step S902), the controller 300 sets a standby mode in which printing is not available to the print controller 633 in step S905, until the control lever 625 moves away from the air release position.

As described above, the lever sensor 631 detects whether or not the control lever 625 is at the air release position. The image forming apparatus 1J performs an image forming operation based on a detection result provided by the lever sensor 631. Therefore, the image forming apparatus 1J may provide effects common to the image forming apparatus 1I (depicted in FIG. 33). The lever sensor 631 detects whether or not the control lever 625 is at the air release position, preventing a timeout error caused by an improper negative pressure formed during a negative pressure forming operation performed while air is released.

According to the above-described exemplary embodiments, an image forming apparatus (i.e., the image forming apparatus 1, 1A, 1B, 1C, 1D, 1E, 1F, 1G, 1H, 1I or 1J depicted in FIGS. 2, 18, 20, 21, 23, 24, 26, 27, 29, 33, or 35, respectively) includes a plurality of liquid discharging heads (i.e., the recording heads 24K, 24C, 24M, and 24Y depicted in FIG. 2) for discharging liquids different from each other and a pressure release member (i.e., the pressure release mechanism 402, 402A, or 602 depicted in FIG. 13, 15, or 33, respectively) for causing inner air pressures in the plurality of the liquid discharging heads, respectively, to be continuously equivalent to an outer air pressure. For example, when the outer air pressure decreases, the pressure release member adjusts the inner air pressures in the liquid discharging heads, respectively, to be continuously equivalent to the outer air pressure. Thus, even when the inner air pressures in the liquid discharging heads, respectively, relatively increase, the air release member may prevent liquid from dripping from nozzles of the liquid discharging heads.

According to the above-described exemplary embodiments, a recording medium, on which the image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. A liquid, with which the image forming apparatus forms an image, is not limited to ink but includes any fluid and any substance which becomes fluid when discharged from the liquid discharging head. The liquid discharging head may discharge a liquid not forming an image as well as a liquid forming an image.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2006-191641 filed on Jul. 12, 2006 in the Japan Patent Office, the entire contents of which are hereby incorporated herein by reference.

What is claimed is:

1. An image forming apparatus, comprising:

a carriage configured to move in a scanning direction;

a plurality of liquid discharging heads mounted on the carriage and configured to discharge respective liquids to form an image;

a plurality of head tanks mounted on the carriage and connected to the plurality of liquid discharging heads to supply the respective liquids to the plurality of liquid discharging heads;

a plurality of air release mechanisms provided in the plurality of head tanks and aligned in a predetermined direction, each of the plurality of air release mechanisms comprising a pressing member;

an air release lever disposed to oppose each of the plurality of air release mechanisms and having a length in a longitudinal direction thereof sufficient to oppose all of the plurality of air release mechanisms, the longitudinal direction of the air release lever corresponding to the predetermined direction in which the plurality of air release mechanisms are aligned;

a support shaft configured to rotatably support the air release lever; and a driver configured to drive and rotate the air release lever about the support shaft, wherein the carriage mounted with the plurality of head tanks including the plurality of air release mechanisms provided in the head tanks moves to a position at which all of the plurality of air release mechanisms oppose the air release lever, and the driver rotates the air release lever about the support shaft to press the air release lever against the pressing members of all of the air release mechanisms and to open the plurality of air release mechanisms substantially simultaneously, to cause an inner air pressure in the plurality of liquid discharging heads to be equivalent to an outer air pressure.

2. The image forming apparatus of claim 1, wherein the air release mechanisms are activated in a standby mode after an image forming operation is finished so as to adjust the inner air pressure in the plurality of liquid discharging heads to be continuously equivalent to the outer air pressure.

3. The image forming apparatus of claim 1, further comprising:

a control panel configured to send a command for activating the air release mechanisms.

4. The image forming apparatus of claim 1, further comprising:

an air release activator configured to activate the air release mechanisms based on one of a detected outer air pressure, a detected altitude at which the image forming apparatus is located, and a detected position at which the image forming apparatus is located.

5. The image forming apparatus of claim 4, further comprising:

an outer air pressure detector configured to detect the outer air pressure.

6. The image forming apparatus of claim 4, further comprising:

an altitude detector configured to detect the altitude at which the image forming apparatus is located.

7. The image forming apparatus of claim 4, further comprising:

a position detector configured to detect the position at which the image forming apparatus is located.

8. The image forming apparatus of claim 4, wherein an outer air pressure detector, separately provided from the image forming apparatus, detects the outer air pressure.

9. The image forming apparatus of claim 4, wherein an altitude detector, separately provided from the image forming apparatus, detects the altitude at which the image forming apparatus is located.

10. The image forming apparatus of claim 4, wherein a position detector, separately provided from the image forming apparatus, detects the position at which the image forming apparatus is located.

11. The image forming apparatus of claim 1, further comprising:

an air release activator configured to activate the air release mechanisms based on a detected signal relating to seat belt lock in an aircraft.

12. The image forming apparatus of claim 1, further comprising:

an air release activator configured to activate the air release mechanisms based on a detected liquid dripping from the at least one liquid discharging head.

13. The image forming apparatus of claim 1, wherein a print request is held when the image forming apparatus receives the print request while the air release mechanisms are activated.

14. The image forming apparatus of claim 1, further comprising a control member configured to be controlled from an outside of the image forming apparatus so as to activate and deactivate the air release mechanisms.

15. The image forming apparatus of claim 14, wherein an image forming operation is performed based on a detection result obtained by a detection part detecting whether or not the control member activated the air release mechanisms.

16. The image forming apparatus of claim 1, further comprising:

a bias unit configured to maintain the air release lever in a position not contacting the air release mechanisms when the driver is not driving the air release lever, so that the air release mechanisms are closed.

17. A method for controlling operations of an image forming apparatus, comprising:

providing a carriage to move in a scanning direction in the image forming apparatus;

supplying liquids from a plurality of respective head tanks to a plurality of liquid discharging heads mounted on the carriage;

discharging the liquids from the plurality of liquid discharging heads mounted on the carriage of the image forming apparatus to form an image;

providing a plurality of air release mechanisms in the plurality of head tanks, the plurality of air release mechanisms being aligned in a predetermined direction, each of the plurality of air release mechanisms comprising a pressing member;

providing an air release lever disposed to oppose each of the plurality of air release mechanisms and having a length in a longitudinal direction thereof sufficient to oppose all of the plurality of air release mechanisms, the longitudinal direction of the air release lever corresponding to the predetermined direction in which the plurality of air release mechanisms are aligned;

moving the carriage mounted with the plurality of head tanks including the plurality of air release mechanisms provided in the head tanks, to a position at which all of the plurality of air release mechanisms oppose the air release lever; and driving and rotating the air release lever about a support shaft to press the air release lever against the pressing members of all of the air release mechanisms and to open the plurality of air release mechanisms substantially simultaneously, to cause an inner air pressure in the plurality of liquid discharging heads to be equivalent to an outer air pressure.

* * * * *